US006240163B1

(12) United States Patent
Zhang et al.

(10) Patent No.: US 6,240,163 B1
(45) Date of Patent: May 29, 2001

(54) RADIATION E.G. X-RAY PULSE GENERATOR MECHANISMS

(75) Inventors: Liyan Zhang, Middletown, NJ (US); Emilio Panarella, Gloucester (CA); Albert Philippe, Ottawa (CA); Jacob Eich, Hull (CA); Stephen Drew, Kanata (CA)

(73) Assignee: Advanced Laser & Fusion Technology, Quebec (CA)

( * ) Notice: Subject to any disclaimer, the term of this patent is extended or adjusted under 35 U.S.C. 154(b) by 0 days.

(21) Appl. No.: 09/261,979

(22) Filed: Mar. 4, 1999

(30) Foreign Application Priority Data

Jun. 19, 1998 (CA) ..... 2241116

(51) Int. Cl.[7] ..... H01J 35/00
(52) U.S. Cl. ..... 378/122; 378/119; 378/121
(58) Field of Search ..... 378/101, 102, 378/103, 106, 119, 121, 138, 122

(56) References Cited

U.S. PATENT DOCUMENTS

| | | | | |
|---|---|---|---|---|
| 3,878,394 | * | 4/1975 | Golden | 378/102 |
| 3,970,884 | * | 7/1976 | Golden | 378/122 |
| 4,201,921 | | 5/1980 | McCorkle | 250/493 |
| 4,210,813 | * | 7/1980 | Romanovsky et al. | 378/101 |
| 5,442,677 | * | 8/1995 | Golden et al. | 378/102 |
| 5,469,490 | * | 11/1995 | Golden et al. | 378/122 |

FOREIGN PATENT DOCUMENTS

| | | |
|---|---|---|
| 851529 | 10/1952 | (DE) . |
| 921040 | 12/1954 | (DE) . |
| 935262 | 11/1955 | (DE) . |
| 0037917 | 10/1981 | (EP) . |
| 57-124841 | 8/1982 | (JP) . |
| 57-184832 | 11/1982 | (JP) . |
| 60-84749 | 5/1985 | (JP) . |
| 60-151945 | 8/1985 | (JP) . |
| 60-157200 | 8/1985 | (JP) . |
| 61-104599 | 5/1986 | (JP) . |
| 61-173496 | 8/1986 | (JP) . |
| 61-225798 | 10/1986 | (JP) . |
| 61-233998 | 10/1986 | (JP) . |
| 62-70567 | 4/1987 | (JP) . |
| 63-116399 | 5/1988 | (JP) . |
| 64-698 | 1/1989 | (JP) . |
| 2-78199 | 3/1990 | (JP) . |
| 3-4700 | 1/1991 | (JP) . |
| 9-035895 | 2/1997 | (JP) . |

OTHER PUBLICATIONS

Werner Schaaffs, Document No. XP–002117206 entitled X–ray flash tube for the investigation of high–speed processes, 1972, communication, Berlin, Germany.

* cited by examiner

*Primary Examiner*—Robert H. Kim
*Assistant Examiner*—Allen C. Ho
(74) *Attorney, Agent, or Firm*—Bourque & Associates, P.A.

(57) ABSTRACT

In an electrode combination for a radiation head for the generation of electromagnetic radiation comprising an anode means having a tip end component and a cathode means, the tip end component comprising a material able to facilitate, in response to a predetermined pulse voltage applied between the anode means and cathode means, the generation of electromagnetic radiation, the improvement wherein the electrode combination comprises a trigger electrode, the tip end component, the cathode means and the trigger electrode being spaced apart from each other by a respective predetermined distance.

39 Claims, 17 Drawing Sheets

RADIATION E.G. X-RAY PULSE GENERATOR MECHANISMS

FIELD OF THE INVENTION

The present invention relates to electromagnetic radiation generators and in particular to X-ray (pulse) generators. Electromagnetic radiation generators find applications in scientific, industrial and medical fields or areas, such as for example, in lithography, in crystallography, in radiography, etc.

BACKGROUND OF THE INVENTION

Known types of electromagnetic radiation generators can be relatively large and relatively costly not only to build but also to maintain and operate; this is especially so if commercial applications are contemplated for a radiation generator.

In the following specific reference will be made by way of example only to X-ray generators however the present invention is not limited thereto; the present invention may, for example, be applied to form an ultra violet light generator, i.e. by providing an ultra-violet light window in place of an X-ray window as described herein.

With respect to X-ray generators, synchrotrons, for example, are relatively large scale known devices which are known for use as X-ray generator devices in commercial environments. Synchrotrons have been described as possible multi-beam X-ray sources for lithography.

Discharge plasma sources have been suggested as possible candidates for a single beam point source for X-rays of relative small size and relatively low cost as compared to the multi-beam approach. Although plasma-based x-ray sources are known which are relatively small in size these have not as yet reached a level of development for commercial purposes in areas such as for example lithography. X-ray sources of this type are, for example, known which comprise an evacuatable discharge chamber an anode, a cathode, a radiation exit port and means for applying a potential as desired between the anode and cathode; see for example European patent specification publication number 0037917. Relatively, small size X-ray generators of this type are also known which exploit a hollow cathode in which the tip of an anode is axially aligned with the passage in the cathode; the presence of the hollow cathode produces beams which are more or less focused; see for example, "X-ray spots emitted in a hollow cathode ns-discharge", Plasma Sources Sci. Technol. 5 (1996) 70–77 IOP Publishing limited, printed in the UK.

It would be advantageous to have a radiation generator such as an X-ray generator which may be used in sub-micron-lithography.

It would in particular be advantageous to have a radiation source which is simple but which is able to generate short bursts of radiation having maximum intensity for nanometre wavelengths.

SUMMARY OF THE INVENTION

The present invention provides in one aspect in an electrode combination for a radiation head for the generation of electromagnetic radiation comprising an anode means having a tip end component and a cathode means, said tip end component comprising a material able to facilitate, in response to a predetermined pulse voltage applied between said anode means and cathode means, the generation of electromagnetic radiation, the improvement wherein said electrode combination comprises a trigger electrode, said tip end component, said cathode means and said trigger electrode being spaced apart from each other by a respective predetermined distance (i.e. gap).

In accordance with another aspect the present invention provides in a radiation head for the generation of predetermined electromagnetic radiation comprising a radiation generation chamber, an anode means having a tip end component, and a cathode means, said chamber having a radiation transmitting window of a material preferentially transparent to a predetermined radiation generated in said chamber and through which the predetermined radiation may be emitted from said radiation head, said anode means and cathode means being disposed in said chamber, said tip end component comprising a material able to facilitate, in response to a pulse voltage applied between said anode and cathode, the generation of electromagnetic radiation, the improvement wherein said radiation head comprises a trigger electrode, said tip end component, said cathode means and said trigger electrode being spaced apart from each other by a respective predetermined distance (e.g. gap).

In accordance with yet another aspect of the present invention, there is provided a radiation head for the generation of predetermined electromagnetic radiation including a radiation generation chamber, an anode means having a tip end component, a cathode means, and a trigger electrode. The radiation generation chamber has a radiation-transmitting window of a material preferentially transparent to a predetermined radiation generated in the chamber and through which the predetermined radiation may be emitted from the radiation head. The anode means and the cathode means are disposed in the radiation chamber, while the tip end component of the anode means includes a material able to facilitate, in response to a pulse voltage applied between the anode and the cathode, the generation of electromagnetic radiation.

The tip end component, the cathode means and the trigger electrode are spaced apart from each other by a respective predetermined distance. The improvement characterized in that the radiation head includes capacitor means, for storing electric energy supplied by a high voltage source. The capacitor means includes a terminal electrode for connection to the anode means, and wherein the anode means is directly electrically connected to the terminal electrode of the capacitor means so as to be integral with the capacitor means.

Another feature of the present invention is that the terminal electrode may be disposed in the radiation generation chamber. In another aspect of the present invention, the capacitor means may be disposed within the radiation generation chamber.

The predetermined gap(s) between the anode, cathode and trigger electrode, as well as the relative voltages between the anode, cathode and trigger electrode, may be selected by appropriate experimentation in light of the radiation it is desired to obtain. In any event the closer the trigger electrode is to the cathode the lower the voltage requirements are between the trigger electrode and the cathode, i.e. the closer the trigger electrode is to the cathode the easier for the trigger electrode to facilitate discharge between the anode and cathode. It has been observed for example that the closer the trigger electrode is to the cathode the more reliable and consistent the effect of the trigger is with respect to discharge for a given voltage differential between the cathode and anode.

Thus for example, the trigger electrode may be disposed from 5 $\mu$m to up to 1 mm from the cathode e.g. from the cathode passageway; and the voltage difference between the trigger electrode and cathode may be in the range of voltage from 1 kV to 12 kV, e.g. from 7.5 kV to 10 kV.

The anode tip end component may comprise one or more stem or finger member(s). A stem or finger member may be provided with at least one tip end element. The nature of the material constituting the anode determines for example the spectrum of the X-radiation emitted by the anode. For the purposes of obtaining X-rays the anode tip end element may for example be made of a material able to produce the desired X-ray lines (e.g. for 1.2 nanometers or lower; e.g. for 0.8 to 1.4 nanometers); the anode tip end element material may for example be of tungsten, aluminum, copper, tantalum, molybdenum, or the like including their alloys. Moreover, the anode may as desired or necessary be provided with cooling means using the circulation of an appropriate fluid; please see U.S. Pat. No. 5,651,045.

The material may be chosen for the cathode on the basis of the ease with which it to supply electrons, such as, for example, copper, brass, copper/tungsten or the like,.

If the cathode means comprises a cathode passageway such as for example described herein, the at least one tip end element may be aligned with the cathode passageway. The cathode passageway if present may have a longitudinal axis and the trigger passageway if also present may have an axis coincident with the longitudinal axis of the cathode passageway.

The discharger or trigger electrode makes it possible to facilitate the release of the electric energy stored in the capacitor.

In accordance with the present invention a trigger unit may comprise the cathode, a trigger electrode, and a suitable power supply able to provide a required or desired high voltage (HV) pulse. In a non-working condition, there is no voltage difference between the cathode and the trigger electrode. On the other hand, during a working or triggering condition, the power supply discharges through a switch so as to send a HV pulse to the trigger electrode, and there will be a spark between cathode and trigger electrode. The small spark will ignite the discharge spark between anode and cathode.

The trigger electrode may, as shall be described and shown herein by way of example, be disposed about the cathode, e.g. on either side of the cathode relative to the anode. In accordance with the present invention the trigger electrode may be disposed between the anode means and the cathode means; alternatively, the trigger electrode may be disposed such that the cathode means is between the trigger electrode and the cathode; as desired the trigger electrode may even be disposed around a portion of the cathode. The trigger electrode may have a tip end element such as for the anode means but may alternatively be configured so as to define an annular passage, e.g. have a loop-like element.

The trigger electrode may take on any desired or necessary configuration keeping in mind its function, i.e. to facilitate discharge. The trigger electrode may comprise a stem or finger element(s). On the other hand, the trigger electrode may, for example, comprise a peripheral element defining a trigger passageway. The trigger electrode may thus for example be a loop trigger electrode wherein the trigger electrode has a loop element which defines a trigger passageway. The loop element may be a complete loop or may have one or more breaks; in the case of one or more breaks, the loop element may comprise a plurality of loop segments which may be curved or straight and which are of course electrically connected one to the other. The loop element may thus for example be more or less circular in configuration; alternatively the loop may be polygonal or rectangular in configuration. The trigger electrode may for example, as desired, alternatively take the form of a plate which is provided with an annular opening corresponding to the trigger passageway.

The cathode electrode may take on any desired or necessary configuration keeping in mind its function is also to provide an electrical discharge. The cathode means may comprise a plate member having a more or less uninterrupted surface or face opposite the anode. On the other hand, the cathode means may, for example, comprise a hollow cathode component which has a cathode passageway extending there through. The trigger electrode may comprise an annular passageway facing the cathode passageway.

The trigger electrode may in particular for example comprise an outer annular component and the cathode means may for example comprise a hollow cathode component having a cathode passageway extending there through. In this case the hollow cathode component may comprise an inner annular element defining at least a portion of the cathode passageway and the trigger outer annular component may be disposed coaxially with the cathode inner annular element.

In accordance with the present invention the cathode may be provided with or have a frustoconical shaped passageway having a small opening end and a large opening end. The frustoconical shaped passageway may have a central longitudinal axis passing through the small and large openings and the anode tip end component may comprise at least one tip end element facing the small opening end and having an axis aligned with the said central axis.

A radiation generation chamber in accordance with the present invention may take on any desired (known) configuration suitable for facilitating the generation of radiation therein; it may for example be an evacuatable radiation discharge chamber; it may be a gas tight chamber for maintaining a vacuum; it may be a gas tight chamber which may contain a desired or necessary gas. The radiation emitting chamber may thus for example have an outer wall component which may be made from stainless steel or aluminum and within which a vacuum environment may be established. Pumping means tightly communicate with the interior of the emitting chamber in order to form a vacuum therein; a vacuum environment facilitates the generation of radiation at high repetition rates. If necessary, the emitting head may be enveloped with a fine radiation (e.g. X-ray) absorption envelope, which may, for example, be made from lead.

A radiation head as defined above may, for example, be exploited for the generation of desired electromagnetic radiation such as for example X-rays, i.e. it may be an X-ray emitting head. In this case the chamber may have an X-ray transmitting window of a material preferentially transparent to X-rays generated in the chamber and through which X-rays may be emitted from such a radiation head.

Accordingly, in accordance with a further aspect the present invention provides a radiation (e.g. X-ray) pulse generator system comprising:

- a radiation (e.g. X-ray) emitting head as defined above
- capacitor means for storing electric energy supplied by a high voltage source and
- trigger voltage pulse means for applying an electric pulse to said trigger electrode such that electric energy stored in the capacitor means is released between said anode and said cathode.

The radiation (e.g. X-ray) pulse generator system may be configured such that a single trigger voltage pulse may be applied to the trigger electrode; alternatively the radiation (e.g. X-ray) pulse generator system may be configured such that a series of periodic trigger voltage pulses may be applied to the trigger electrode. In the latter case, a series of radiation pulses may be produced at a desired or necessary cycle rate.

As mentioned above, the radiation generation chamber may as desired have an X-ray transmitting window of a material preferentially transparent to X-rays. On the other hand, if it is desired to obtain another type of radiation, such as for example Ultra-violet radiation, a radiation transmitting window may be used which is of a material preferentially transparent to the other desired radiation generated in said chamber and through which the desired radiation may be emitted from said radiation head.

The capacitor means for storing electric energy supplied by a high voltage source may comprise any (suitable) known capacitor which is able to undergo the desired or necessary discharge/recharge cycles, e.g. be able to facilitate the obtaining of the desired or necessary radiation pulse rates. The capacitor(s) may be a discreet capacitor(s) such as for example a disk capacitor(s). The capacitor may for example be a vacuum capacitor (model CFED—1000—25S) made by Jennings or Comet (a vacuum capacitor made by Swiss, custom design or custom made per Comet specification sheet 0-0529).

The capacitor may, for example, advantageously be directly or essentially directly connected to the anode means. The capacitor may for example as described herein be completely disposed within the evacuatable radiation discharge chamber; if desired, the capacitor may be so disposed such that at least a part thereof is within the discharge chamber such that the terminal electrode thereof which is (directly) electrically connected to the anode means is also within the discharge chamber; alternatively, the capacitor may be disposed outside of the discharge chamber in which case the anode means may define a part of the wall of the discharge chamber and the terminal capacitor electrode may be directly electrically connected to the anode means. In either case, the purpose is to minimize the length of electrical connectors electrically linking the anode and the capacitor. This disposition of the capacitor makes it possible to obtain extremely fast electric discharges with a very high voltage (a few kV to 150 kV), the duration of the pulses being for example below 100 ns Full Width Half Maxim (HWHM), e.g. below 50 ns HWHM.

An X-ray pulse generator system according to the invention may also comprises a high voltage source; the high voltage source may be any (suitable) source which for example is able to provide the desired or necessary recharge rates as a function of the triggering electric pulse rate or cycles delivered to the trigger electrode. The high voltage source may be a constant high voltage source or a pulse-type high voltage source. The trigger voltage pulse may be emitted after a predetermined time interval after the charge of the capacitor reaches a desired value, e.g. just after reaching the desired charge. The high voltage source may for example be one which may be able to deliver from 2 to 150 kV and which is able to recharge the capacitor(s) at frequencies which may vary between from 0.1 Hz to 500 kHz, as a function of the desired configuration.

The trigger voltage pulse means may take on any desired or necessary form keeping in mind that it must be able to deliver the desired voltage pulse cycles to the trigger electrode in synchronisation with the recharge rate of the capacitor means. The trigger pulse means comprise means for providing a high voltage triggering pulse to ignite the releasing of the electric power stored in a storage capacitor (s). The trigger pulse means may, for example, be of a type able to operate between from 0.1 Hz to 500 kHz. A suitable triggering pulse means may comprise a DC power supply, switches/relays, capacitors, transformers, diodes, etc. which are interconnected in any suitable (known) fashion.

The voltage between the anode and cathode may for example be 2 to 150 kV for a predetermined gap therebetween of from 0.2 mm to 10 mm.

The voltage between trigger electrode and cathode may for example be from 1 kV to 12 kV for a predetermined gap therebetween of from 0 to 1 mm or more, e.g. of from 5 $\mu$cm or more.

A generator according to the invention may be configured so as to be able to emit over very short times (equivalent to the length of the pulse), a much more intense X-radiation than that emitted by the conventional generators generally used in laboratories and in industry.

BRIEF DESCRIPTION OF THE DRAWINGS

The invention is described in greater detail hereinafter relative to non-limitative example embodiments which are illustrated in the attached drawings, wherein.

DETAILED DESCRIPTION OF THE INVENTION

Figure 1:
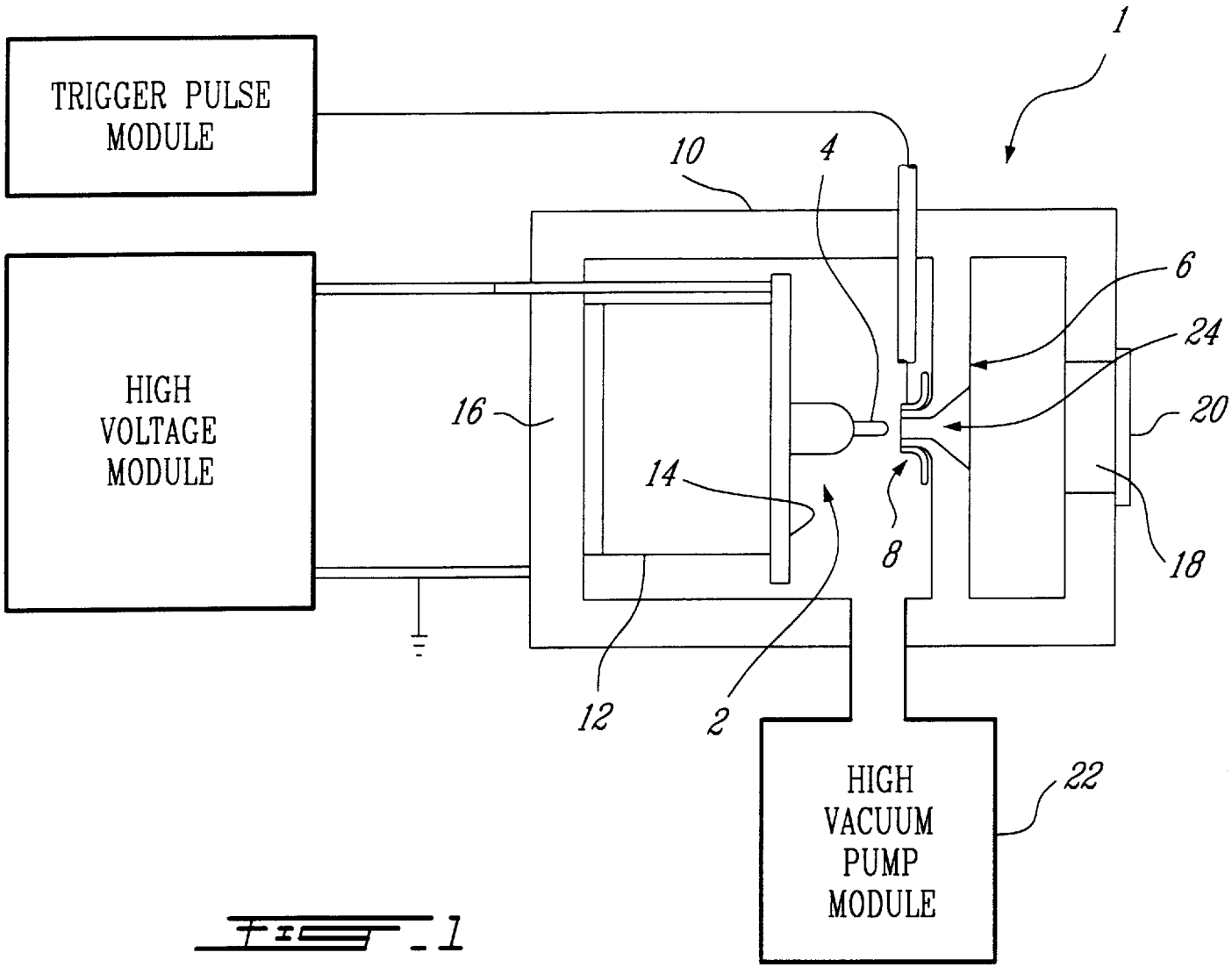
FIG. 1 is a schematic illustration of an X-ray generator system according to the present invention.

The X-ray pulse generator system shown in FIG. 1 comprises a radiation head 1, a trigger pulse module (i.e. trigger voltage pulse means) for providing a trigger pulse voltage, a high voltage module for providing a high voltage between the anode and cathode parts and a vacuum module. The radiation head 1 comprises an electrode combination in accordance with the present invention. The electrode combination comprises an anode 2 having a tip end component 4, a cathode 6 and a trigger electrode 8.

Figure 3:
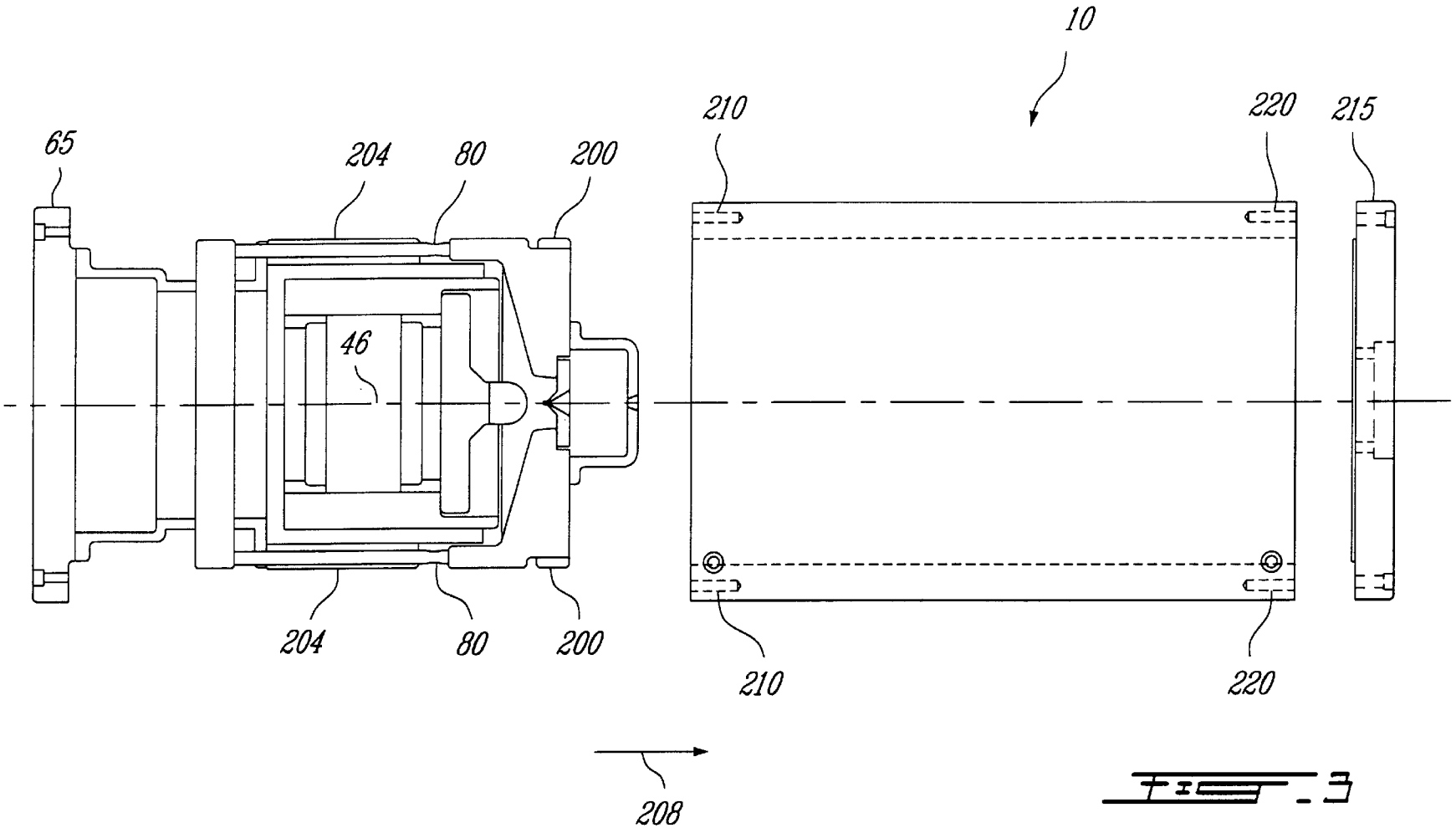
FIG. 3 is a schematic illustration of the X-ray generator module of FIG. 2 in the process of being installed in an evacuatable housing.

The X-ray pulse generator system also has a radiation generation chamber in which the electrode combination is disposed, i.e. an outer housing 10 in which the other elements are disposed (please see FIG. 3). A two terminal capacitor 12 is also disposed in the radiation chamber. The anode 2 is directly connected to a terminal electrode 14 of the capacitor 12. If desired the capacitor 12 may alternatively extend out of the wall 16 of the radiation chamber such that the terminal electrode 14 may define a part of the chamber wall 16.

The chamber wall of the radiation generation chamber is in any event provided with an opening 18 covered by a thin air tight wall 20, the opening 18 and wall 20 defining an X-ray radiation transmitting window. The wall 20 is made from a material preferentially transparent to the X-rays produced, i.e. this wall 20 acts as an X-ray transmitting window which allows X-rays to pass there through while being opaque to other types of radiation; the material may for example be of beryllium (Be) which is 12.5 microns thick. The X-ray transmitting window faces the cathode 6 such that the cathode 6 is disposed between the X-ray transmitting window and the anode 2 in order to permit the exit of the X-radiation. The radiation transparent window may be held in place in any suitable (known) manner; for example, a Be disk may be glued in place with opaque glue on a shoulder provided by an aluminum disk vacuum sealed to chamber.

The radiation chamber is configured so as to be gas tight such that the high vacuum pump module 22 when activated is able to create the desired or necessary vacuum in the radiation chamber.

The emitting head shown is provided with the above mentioned anode 2 having an anode tip 4 and the above mentioned cathode 6 having a passageway 24, i.e. the cathode 6 is a hollow cathode; the anode and cathode are positioned so as to face one another in the emitting head. The electric discharges leading to the formation of X-rays take place between the anode tip 4 and the cathode 6.

Figure 2:
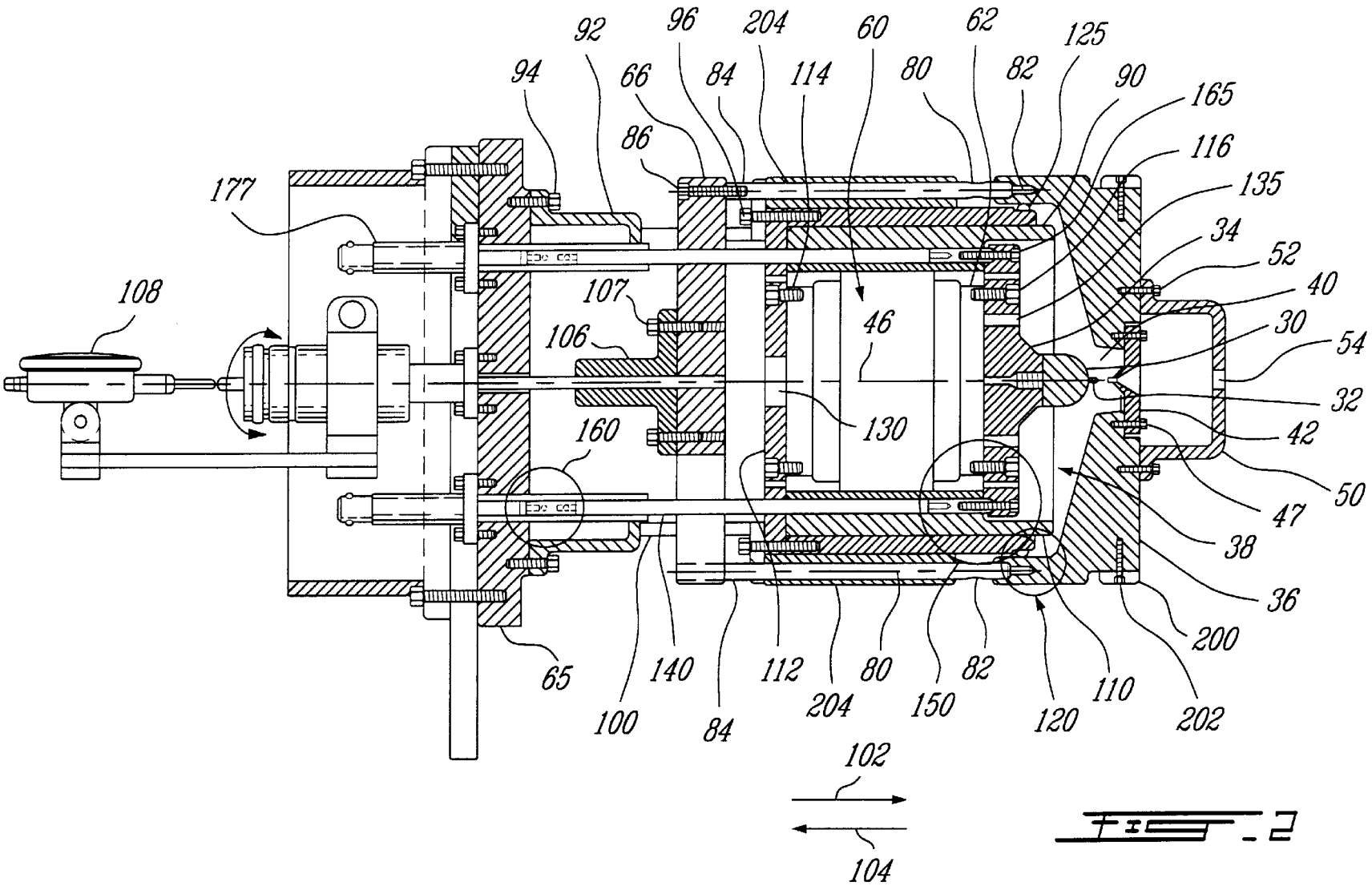
FIG. 2 is a schematic illustration of an X-ray generator module according to the present invention.

Turning to FIG. 2, this figure schematically illustrates in further detail an example of an X-ray generation module in accordance with the present invention which comprises a cathode part and an anode part. The anode part includes an anode nut 30 which has a tip end component 32; the anode nut 30 is screw attached to a disc shaped end member 34. The trigger electrode is not shown in FIG. 2; please see FIGS. 4 and 5. The cathode part includes a hollow cylinder shaped end cathode holder plate member 36.

The end cathode holder plate member 36 has an open ended hollow like configuration and is provided with a wide mouth end (indicated generally by the reference numeral 38) and a small mouth end (indicated generally by the reference numeral 40).

The small mouth end 40, is covered by a hollow open ended cathode component 42 which is fixed to the end cathode holder plate member 36 by bolt members one of which is designated by the reference numeral 44. The hollow open ended cathode component 42 has a passageway which is more or less coaxial with the longitudinal axis 46 of the module. A cathode housing member 50 is also attached to the end cathode holder plate member 36 by bolt members one of which is designated by the reference numeral 52. The cathode housing member 50 is provided with a widow opening 54 which is also more or less coaxial with the longitudinal axis 46 of the module. The widow opening 54 is closed off by a material (not shown) preferentially transparent to the X-rays such as described above.

The X-ray generation module also includes a two terminal storage capacitor 60. In the exemplified module the anode part is directly connected to the terminal electrode 62 of the capacitor 60; i.e. the terminals of the storage capacitor are connected on the one hand to the high voltage source and on the other hand (directly) to the anode. This disposition of the storage capacitor 60 makes it possible to obtain extremely fast electric discharges with a very high voltage (a few kV to 150 kV in the example shown), the duration of the pulses being below 50 ns.

The X-ray generation module is shown by way of example in FIG. 2 as being configured to facilitate the variation of the spacing or distance (i.e. gap) between that anode tip end component and the cathode part; this gap may of course alternatively be of a fixed distance. The X-ray generation module shown has three main plate members to which various other elements are attached namely, a rear disc shaped end base plate member 65, an intermediate Y-shaped push-pull plate member 66 and the above mentioned hollow cylinder shaped end cathode holder plate member 36.

Figure 2A:
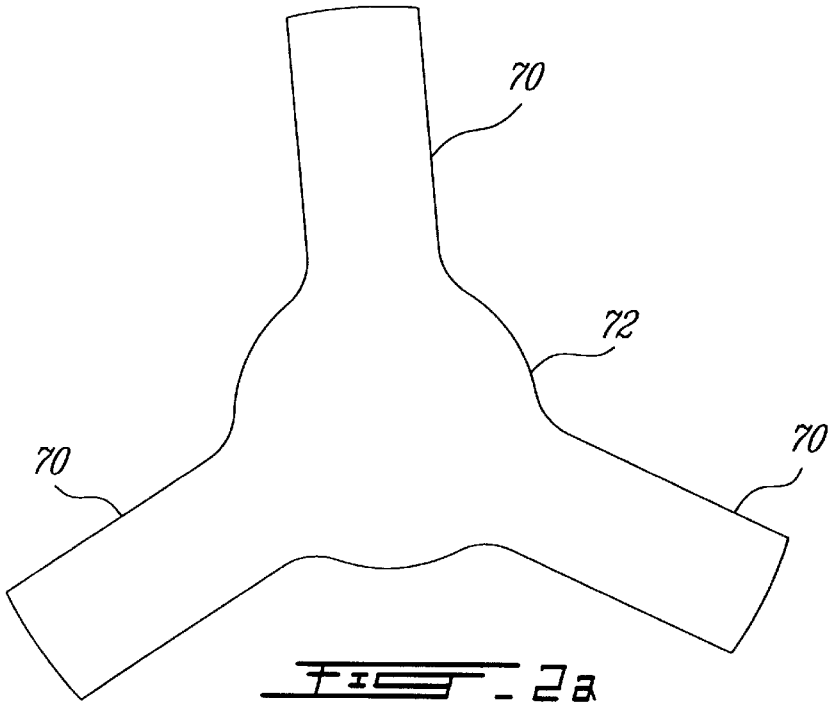
FIG. 2*a* is a schematic illustration of a Y-shaped push-pull member shown in FIG. 2

The Y-shaped push-pull plate member 66 is shown in outline in FIG. 2*a* and has three connector arms 70 which extend outwardly from a central hub 72 such that the angle between each adjacent connector arms 70 is more or less 120 degrees.

The Y-shaped push-pull plate member 66 and the end cathode holder plate member 36 are more or less fixedly or rigidly attached to each other so as to form the basis of a travelling unit. For the example module shown in FIG. 2, the distal ends of each of the connector arms 70 of the Y-shaped push-pull plate are releasably fixed to the end cathode holder plate member 36 by respective push/pull sliding spacer connector rods 80. Each of the connector rods 80 has a threaded male end 82 and an inner threaded female opening end 84. The end cathode holder plate member 36 is provided with threaded female openings each of which screw engages the male end 82 of a respective connector rod 80. On the other hand the distal ends of each of the connector arms of the Y-shaped push-pull plate are provided with a bolt opening. Each bolt opening is sufficiently large so as to allow the threaded stem of a respective bolt 86 to pass there through (but not the bolt head) such that the bolt stem may screw engage a threaded female opening of a respective connector rod 80 so as to clamp the connector arms 70 between a bolt head and the connector rod 80.

The travelling unit may be displaceably connected to the end base plate member 65 in any suitable (known) fashion such that the gap between the anode tip end component and the cathode part may be adjusted as desired. In this respect the module shown in FIG. 2 has a capacitor cup holder 90 which is fixed to the end base plate member 65 by a hollow cylindrically like shaped capacitor cup connector 92. The capacitor cup connector 92 is fixed to both the end base plate member 65 and to the capacitor cup holder 90 by respective bolt members; one of the bolt members which fixes the capacitor cup connector 90 to the end base plate member 65 is designated by the reference numeral 94 whereas one of the bolt members which fixes the capacitor cup connector 92 to the capacitor cup holder 90 is designated by the reference numeral 96.

The capacitor cup connector 92 is provided with three axially extending guide slots configured for slidingly engaging a respective connector arm 70 of the Y-shaped push-pull plate member 66; one of the guide slots is designated with the reference numeral 100. The distal end of each connector arm extends out of a respective guide slot 100. The guide slots 100 are each sized such that they are axially larger than the distal end of a respective connector arm 70 such that these distal ends have an axial freedom of movement in the direction of the arrows 102 and 104. The means for inducing such movement may take on any suitable (known) configuration, e.g. it may for example include a (known) linear motion connector 106 attached to plate member 65 by bolts such as bolt 107, the linear motion connector being connected to a spacing adjustment dial 108.

Turning back to the capacitor cup holder 90, the holder 90 has disposed therein an open ended capacitor insulator cylinder 110 as well as the two terminal capacitor 60. The capacitor insulator cylinder 110 slidingly engages the interior wall surface of the capacitor cup holder 90. One end of the capacitor insulator cylinder 110 is provided with an interior recess radially larger than the radial peripheral edge of the disk shaped anode plate 34; the interior recess is provided with a interior shoulder. The capacitor 60 is disposed within and slidingly engages the interior surface wall of the capacitor insulator cylinder 110. One end of the capacitor 60 is releasably fixed to the floor 112 of the capacitor cup holder 90 by bolt members, one of which is designated by the reference numeral 114. The other end of the capacitor is similarly releasably fixed to the anode plate 34 by bolt members, one of which is designated by the reference numeral 116. The capacitor 60 and the capacitor insulator cylinder 110 are sized and configured such that when the capacitor 60 is fixed to the floor 112 of the capacitor cup holder 90 and the anode plate 34 is bolted to the capacitor 60; although not shown the anode plate 34 is spaced apart a small amount (e.g, 1 mm or less) from the interior shoulder of the capacitor insulator cylinder 110.

Figure 2B:
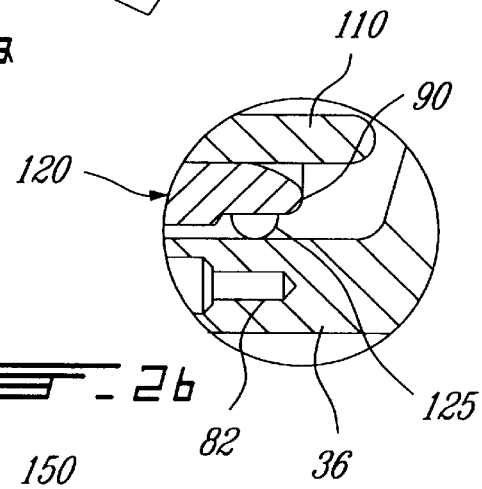
FIG. 2*b* is a schematic detail illustration of the capacitor cup to cathode connection shown in FIG. 2.

The large mouth end 38 of the end cathode holder plate member 36 is so configured and sized such that a portion of the anode end of the peripheral side wall of the capacitor cup holder 90 may be received within the large mouth end 38, i.e. there is a gap there between which allows the travelling unit to be displaced along the longitudinal axis 46 in the direction of the arrows 102 and 104. An electrical connection is nevertheless provided between the end cathode holder plate member 36 and the capacitor cup holder 90 as may be seen from the detail 120 of FIG. 2*b*. Turning to detail FIG. 2*b*, an annular groove is disposed on the outer surface of the capacitor cup holder adjacent to anode opening edge thereof. An electrical connector ring 125 is seated or disposed in the annular groove and is sized and configured so as to be able to slidingly abut against the inner surface of the large mouth end 38 and provide an electrical bridge or connection between the capacitor cup holder 90 and the cathode holder plate member 36. The presence of the electrical connector ring 125 preserves the electrical connection between the end cathode holder plate member 36 and the capacitor cup holder 90 as the travelling unit is displaced back and forth along the longitudinal axis 46 for positioning the end tip component 32 at the desired or necessary distance from the hollow open ended cathode component 42.

The rear end base plate member 65, the capacitor cup connector 92, the capacitor cup holder 90, the electrical connector ring 125, the end cathode holder plate member 36, the hollow open ended cathode component 42 and the cathode housing member 50 are of a material which is electrically conductive such that they are electrically interconnected thereby (e.g. they may be mutually grounded by grounding the end base plate member); they may be of the same or different materials.

Figure 2D:
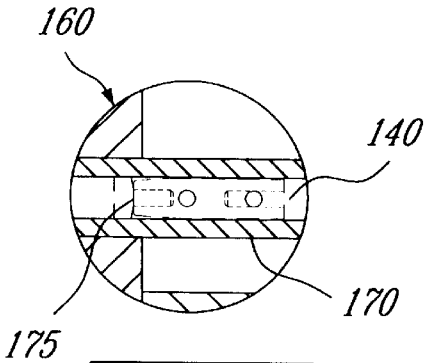
FIG. 2*d* is a schematic detail illustration of a high voltage cable to high voltage connector connection shown in FIG. 2.
Figure 2C:
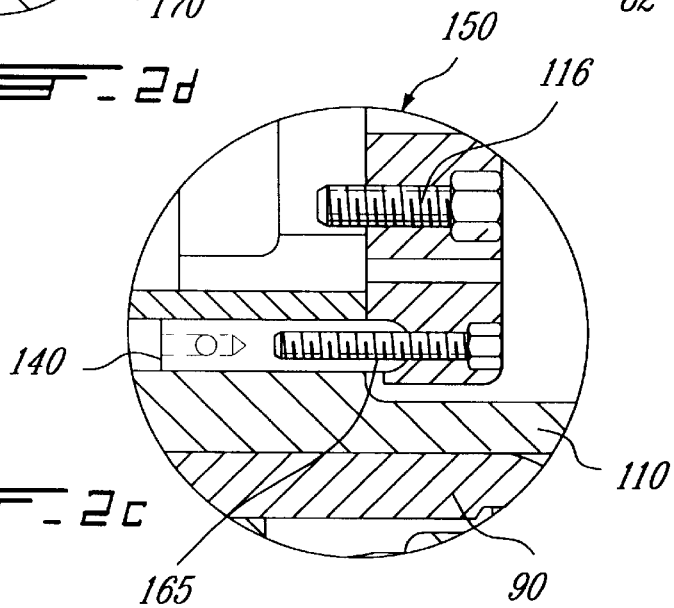
FIG. 2*c* is a schematic detail illustration of a high voltage cable to anode plate connection shown in FIG. 2.

With respect to the anode part of the module, a number (e.g. from 1 to 6) of insulated high voltage cable connector members pass through respective openings in the floor of the capacitor cup holder 90 and peripheral wall connector of the capacitor insulator cylinder 110; one of these insulated high voltage cable connector members is designated with the reference numeral 140. The cable connector members are electrically connected in any suitable (known) manner on the one hand to the anode plate 34 and on the other to suitable high voltage connector means attached to the rear end base plate member 65; the connection to the end base plate is such so as to be air tight and allow for a vacuum to be generated. Example details 150 and 160 are shown in FIGS. 2*c* and 2*d* for possible interconnections which allow for continuous electrical connection at the rear end base plate member 65. FIG. 2*c* shows a fixed connection between the cable connector member 140 and the anode plate 34; i.e. the cable connector member 140 is bolted to the anode plate 34 by bolt 165. On the other hand FIG. 2*d* shows a sliding connection between the cable connector member 140 and the rear end plate member 65; i.e. the end of the cable connector member 140 adjacent the rear end plate member is slidingly engaged in a housing 170 (i.e. an insulating sleeve) and has an inner channel which is in engagement with a friction slip electrical connector element 175 which is electrically connected to a suitable high voltage connector means 177 (see FIG. 2).

The X-ray generation module as shown in FIG. 2 is provided with insulating sliding engagement means for slidingly engaging the interior surface of an outer housing.

The sliding engagement means includes a (sliding) bearing collar 200 which is maintained in place by suitable recessed bolts or screws, one of which is designated by the reference numeral 202. The sliding engagement means may also include sliding rod cylinders 204 disposed about respective connector rods 80.

Referring to FIG. 3, the module of FIG. 2 may be disposed into an open ended cylindrical radiation head housing 10; when the module is displaced in the direction of the arrow 208 into the housing the bearing collar 200 and the sliding rod cylinders 204 will sliding engage the interior surface of the housing 10. The rear end base plate member 65 may function as one of two detachable end cap plates for closing off the ends of the housing 10. Accordingly, the rear end base plate member 65 may be attached to the radiation head housing via threaded openings 210 for receiving the stem of suitable bolts (not shown). The other end plate 215 may have an opening for engaging the window housing 50 and be attached to the radiation head housing 10 also by bolt means via inner threaded openings 220. In any case the end cap plates both engage respective ends of the cylindrical housing and the end cap plate engages the window housing in a gas tight fashion so as to allow for a vacuum to be developed in the radiation head.

In this respect the capacitor 60 shown in FIG. 2 is a plate type capacitor wherein the gap between plates extends along the longitudinal axis of the capacitor from one end thereof to the other. The floor 112 of the capacitor cup holder 90 is provided with an opening 130 whereas the anode plate is provided with openings 135. The guide grooves 100, the gap between plates of the capacitor 60 and the openings 130 and 135 allow the interior to be evacuated so as to place the interior under a desired vacuum, i.e. by a pump means (not shown) connected to the housing 10.

Figure 4:
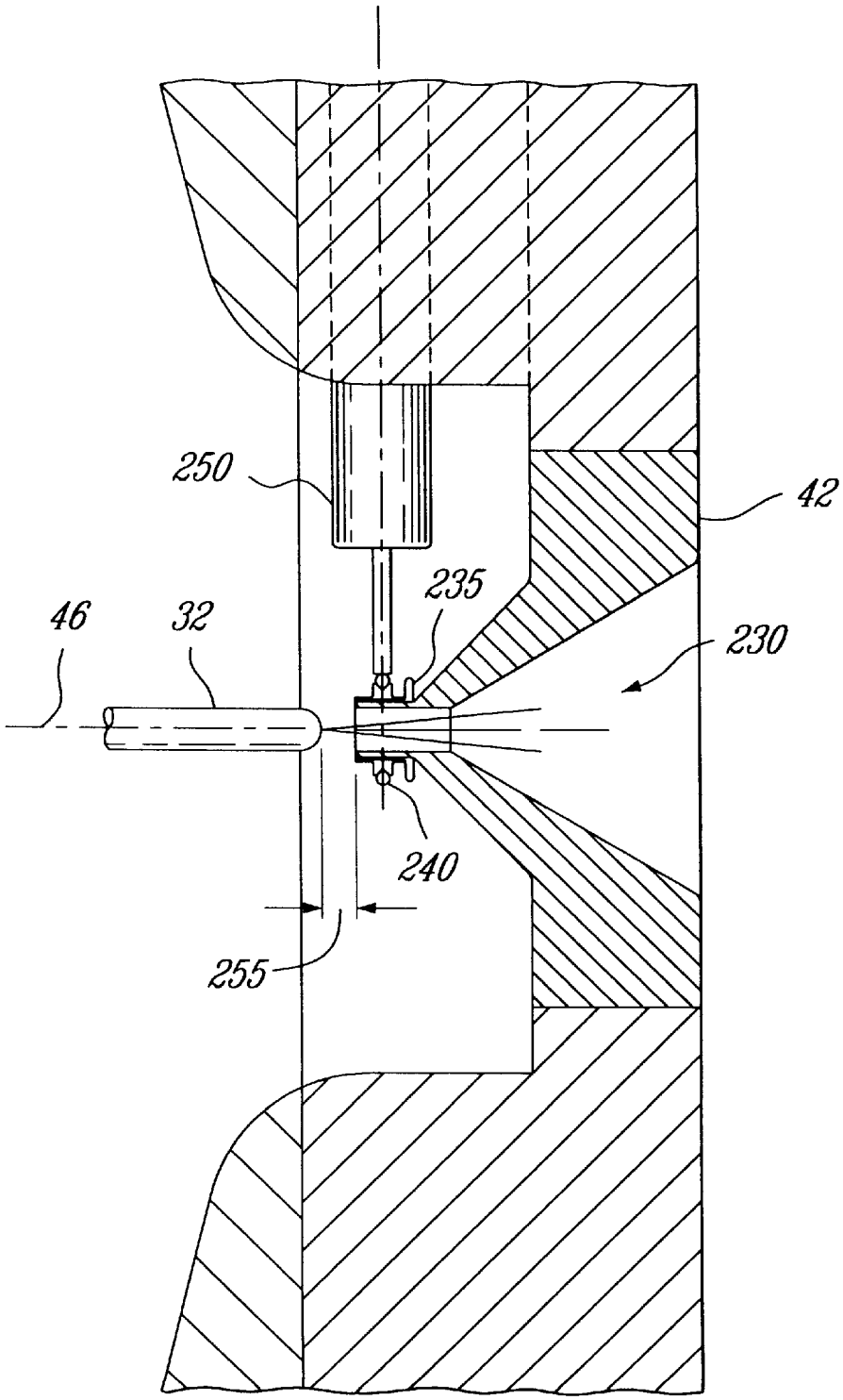
FIG. 4 is schematic illustration of an example anode/trigger/cathode configuration of the present invention.
Figure 5:
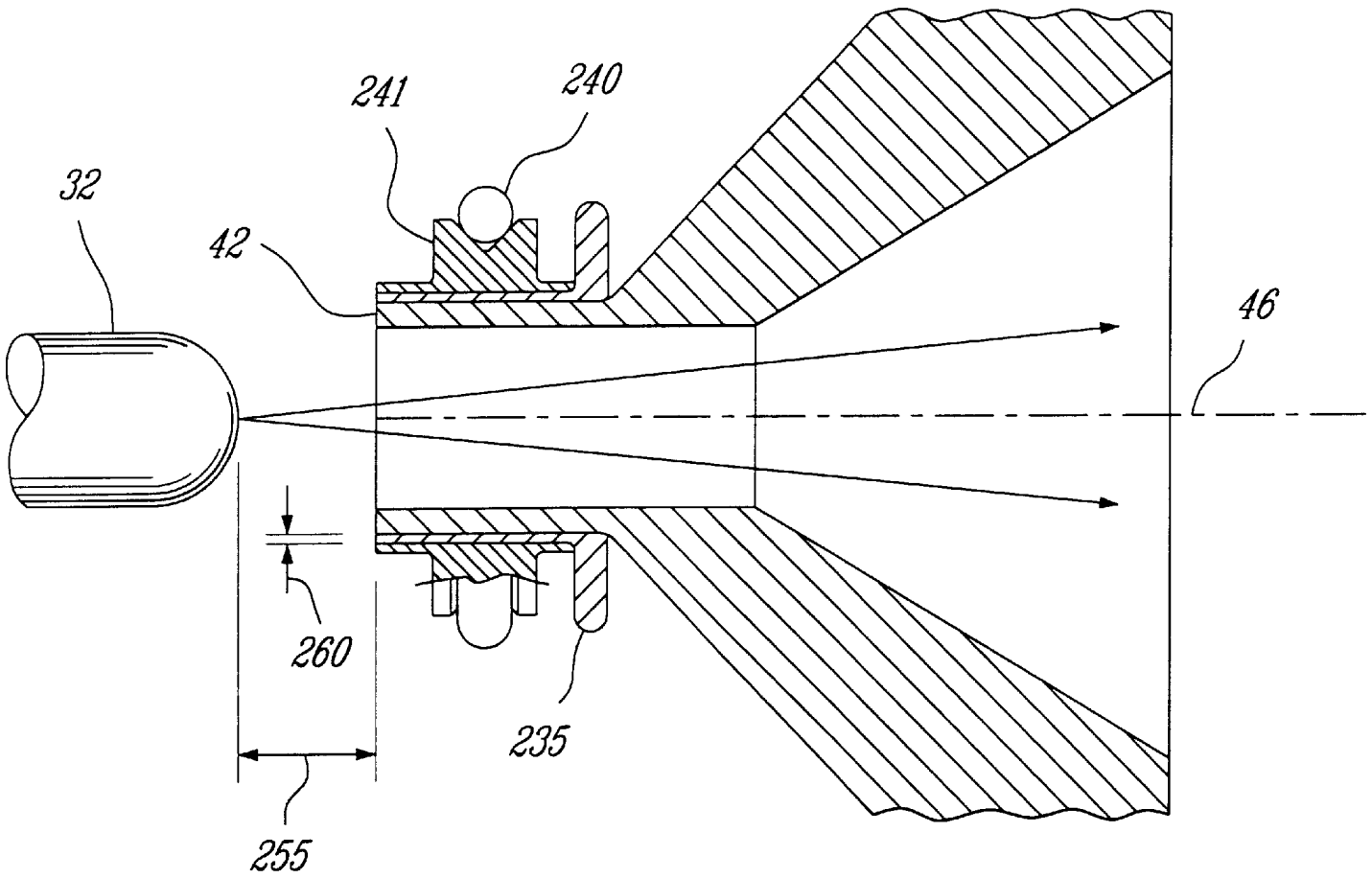
FIG. 5 is an exploded schematic illustration of the anode/trigger/cathode configuration shown in FIG. 4.

FIGS. 4 and 5 schematically illustrate an example anode/trigger/cathode configuration which may for example be used with the module shown in FIG. 2. The hollow cathode component 42 has a cathode passageway designated generally by the reference numeral 230 which extends there through from a small opening to a large opening. The anode tip end component 32 in the illustrated example is shown as being more or less aligned with the cathode passageway, i.e. it is more or less coaxial with the longitudinal axis 46 of the X-ray generation module. The portion of the cathode passageway adjacent the small opening (i.e. the small opening end) has the form of a hollow cylinder of constant cross section whereas the remaining portion of the cathode passageway which terminates in the large opening has a frustoconical like shape, the cross sectional diameter of which increases from the small opening end to the large opening end. A cylindrical insulating member 235 (e.g. a ceramic member) is disposed about and engages the small opening end.

The trigger electrode includes a closed loop member 240 which is seated on and about the cylindrical insulating member in a trigger seat 241 somewhat to one side of the small opening away from the anode tip end component 32. The closed loop member 240 is connected to a trigger pulse module (please see FIG. 1) by an insulated cable 250 which passes through the end cathode holder plate member so as not to detract from the vacuum conditions which may exist in the radiation head incorporating the illustrated example trigger/cathode configuration.

The gap or distance 255 between the small opening and the anode tip end component 32 may for example be from 0.2 to 10 mm for a voltage differential there between of from 2 kV to 150 kV.

The gap or distance 260 between the cathode and the trigger electrode may for example be from slightly more than 0 to 1 mm for a voltage differential there between of from 1 kV to 12 kV.

FIGS. 6 to 11 schematically illustrate an additional example anode/trigger/cathode configurations.

Figure 6:
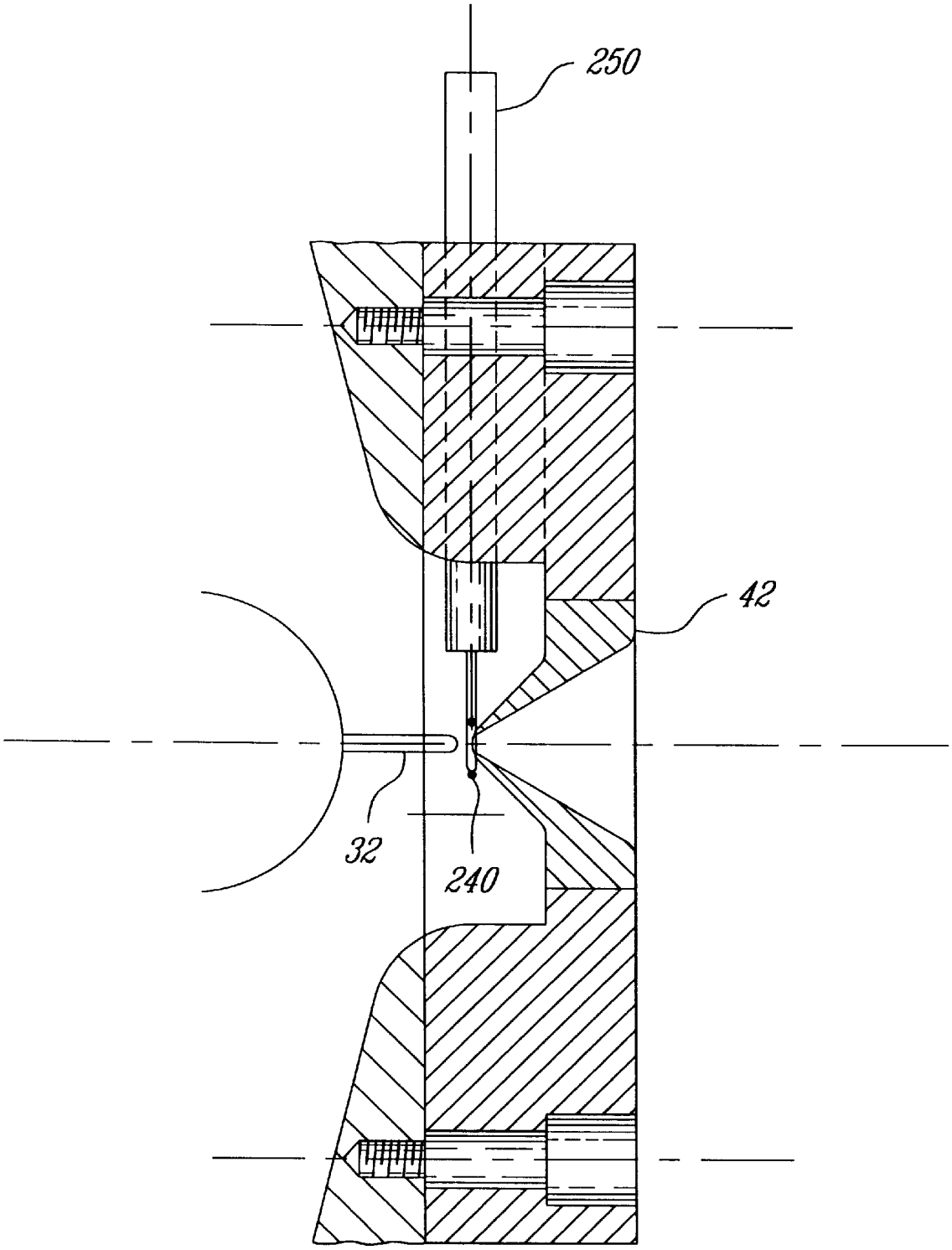
FIG. 6 is schematic illustration of another example anode/trigger/cathode configuration of the present invention.

Turning to FIG. 6 as in the case of the configuration shown in FIG. 4 and 5, the hollow cathode component 42 has a cathode passageway which extends therethrough from a small opening to a large opening passageway. However, the small opening end does not have a portion of constant cross section. Additionally, the closed loop element is more or less aligned with the small opening of the hollow cathode component.

Figure 7:
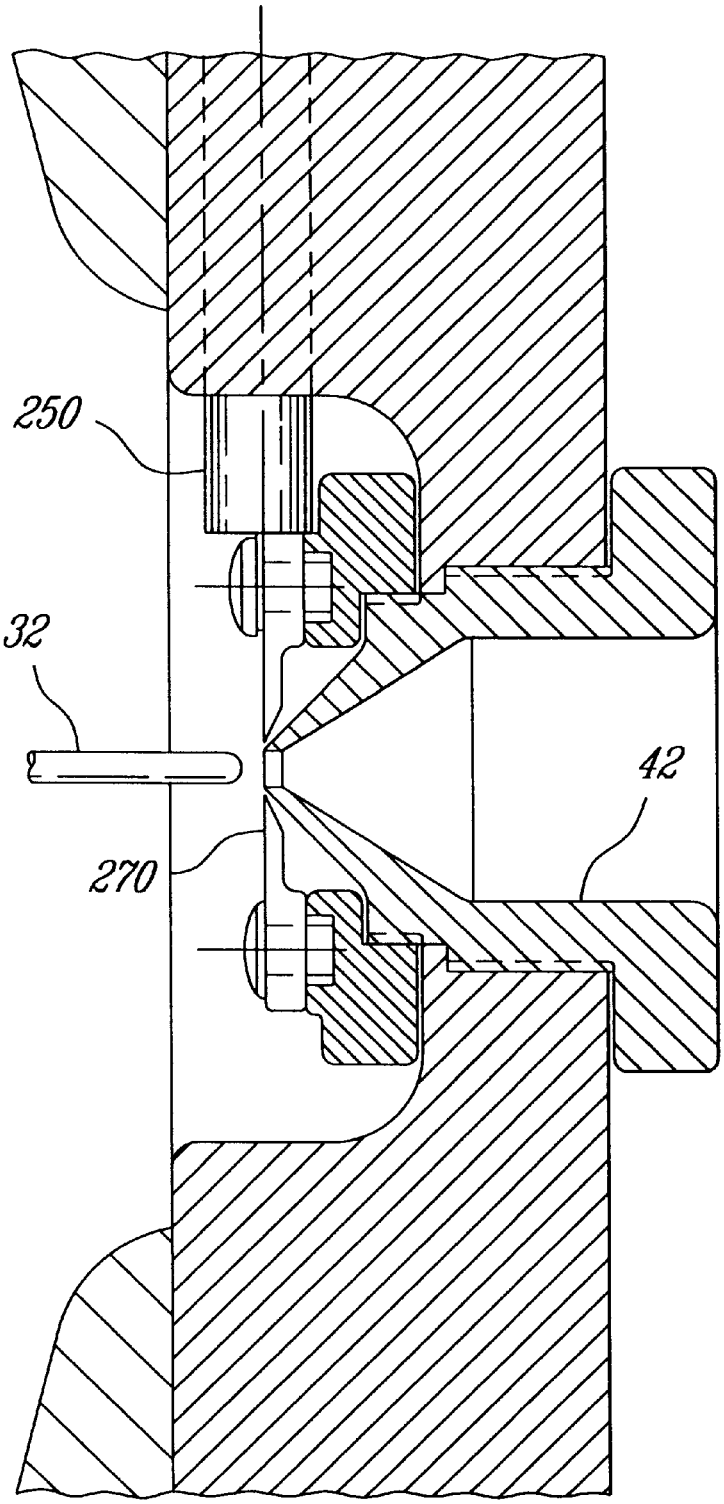
FIG. 7 is schematic illustration of a further example anode/trigger/cathode configuration of the present invention.

FIG. 7 shows a trigger electrode configuration which instead of having a closed loop comprises a trigger plate 270 having a circular knife edge opening; the plate may be configured so as to be adjustable in any suitable (known) fashion for adjusting the distance between the plate 270 and the cathode 42.

Figure 8:
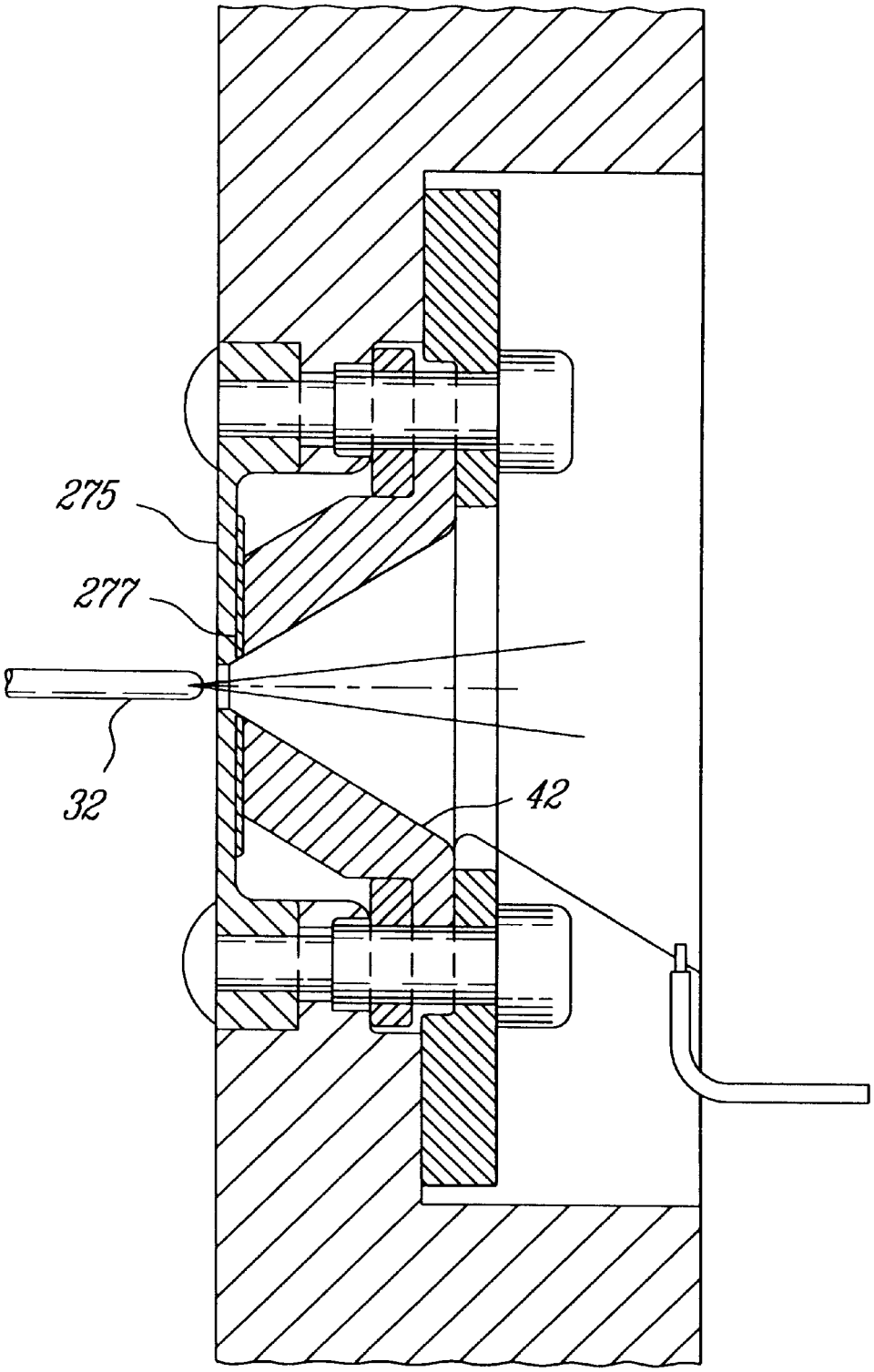
FIG. 8 is schematic illustration of an additional example anode/trigger/cathode configuration of the present invention.

FIG. 8 shows a trigger electrode configuration which instead of having a closed loop exploits triggering by a ceramic surface discharge between a cold trigger electrode plate 275 spaced apart by a teflon washer 277 from the cathode.

Figure 9:
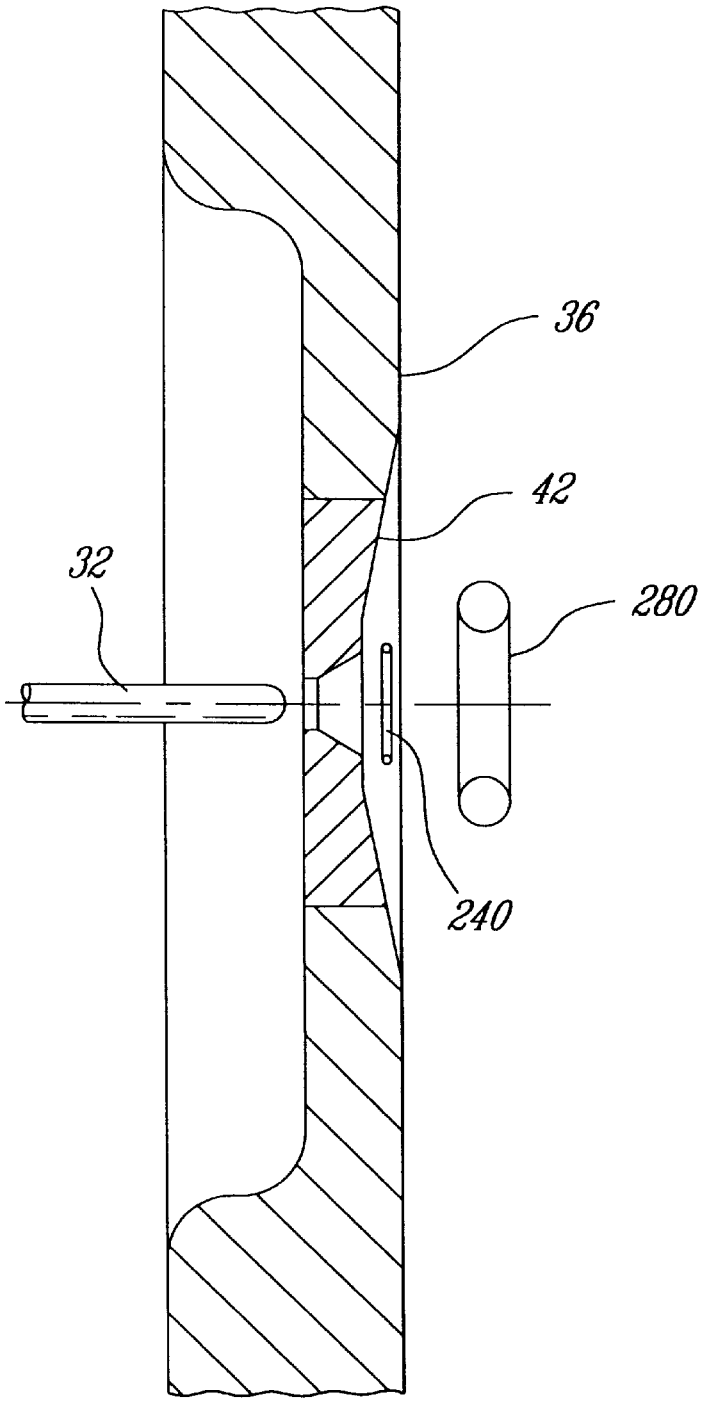
FIG. 9 is schematic illustration of yet another example anode/trigger/cathode configuration of the present invention.
Figure 10:
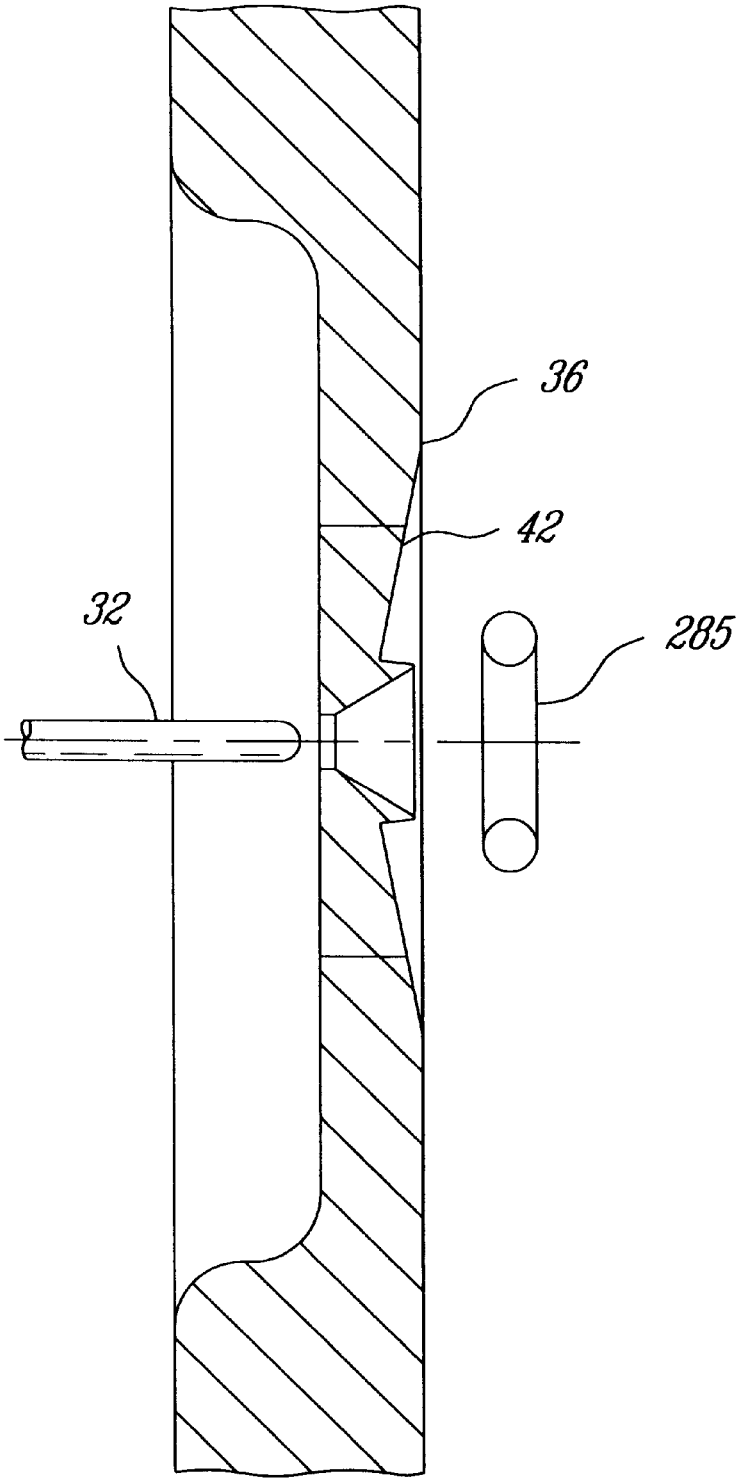
FIG. 10 is schematic illustration of a further example anode/trigger/cathode configuration of the present invention.
Figure 11:
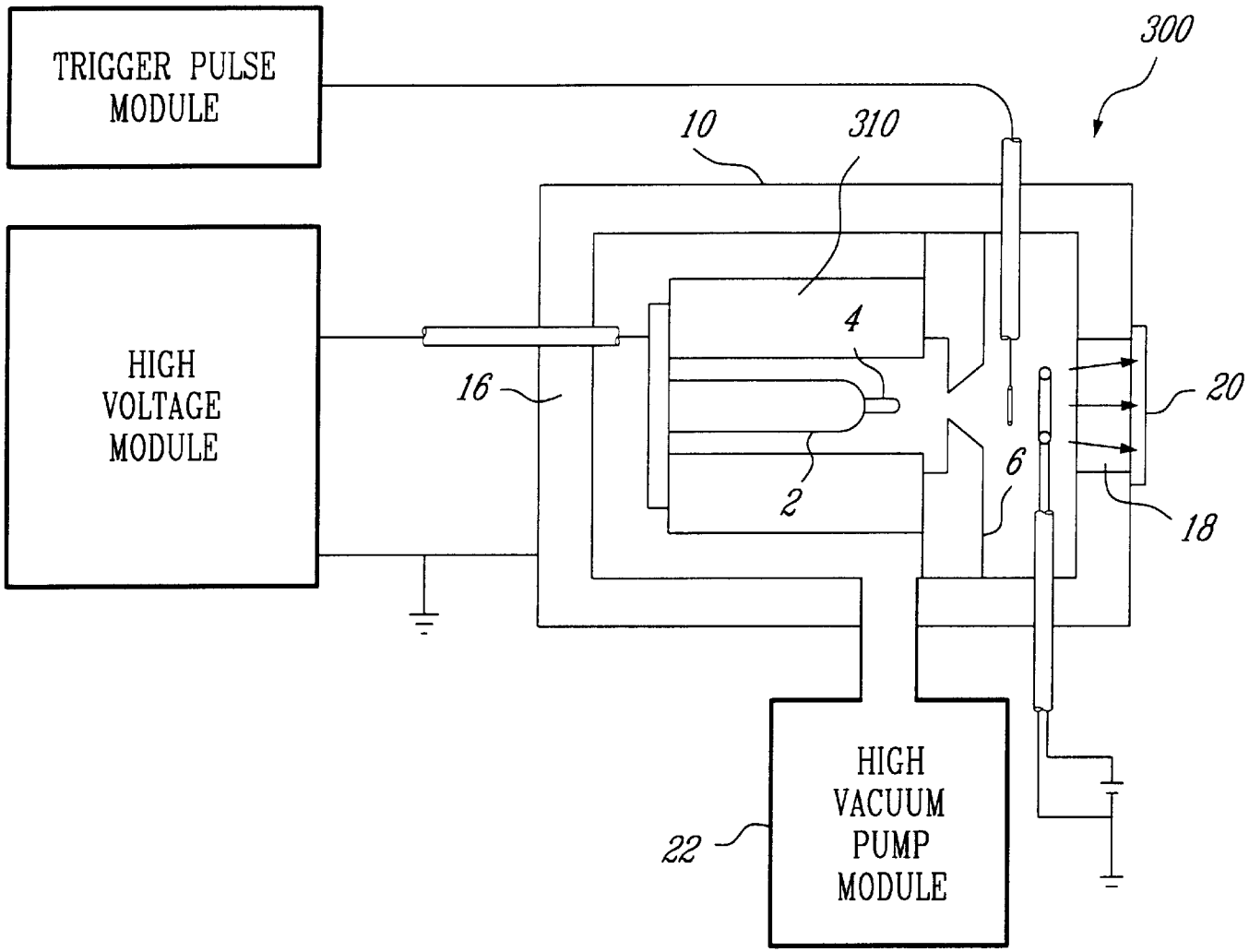
FIG. 11 is a schematic illustration of another example X-ray generator system according to the present invention.

FIG. 9 shows another trigger electrode configuration which instead of having a closed loop exploits triggering by a cold trigger electrode and a heated filament 280 disposed behind the small cathode opening FIG. 10 shows another trigger electrode configuration which exploits triggering including a trigger/heating electrode 285 disposed behind the small cathode opening FIG. 11 schematically illustrates a possible alternate X-ray pulse generator system 300 to that as shown in FIG. 1; to the extent that elements are common to the two versions the same reference numerals are used. The main difference between FIG. 1 and FIG. 11 is that a coaxial vacuum capacitor is replaced by a straight vacuum capacitor 310. The gap adjustment between the anode and cathode may be by means of the movement of anode instead of cathode as in FIG. 1. Any trigger configuration described in previous can be used in the alternative configuration.

Figure 12:
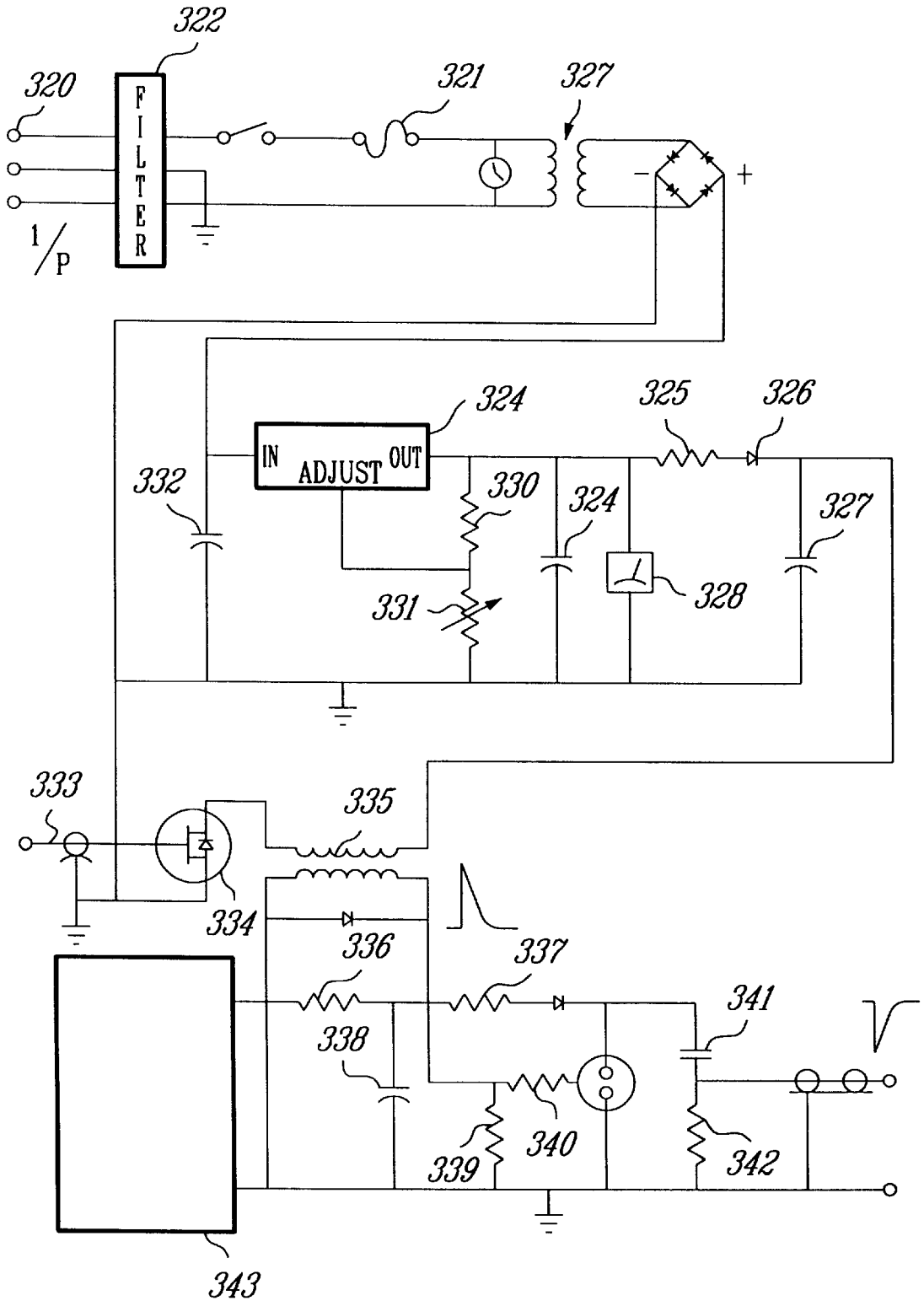
FIG. 12 schematically illustrates an example circuit for a trigger pulse module.
Figure 13:
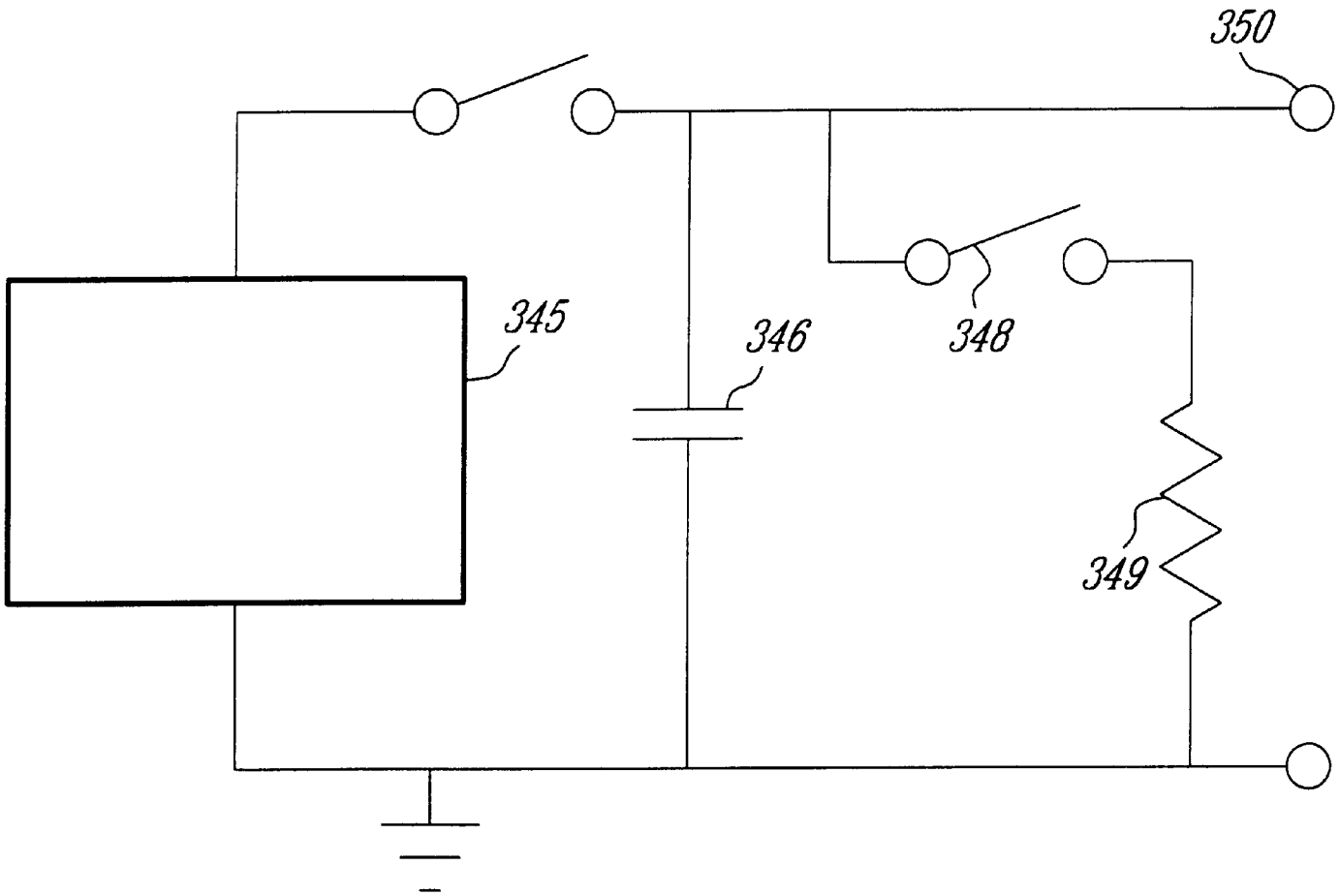
FIG. 13 schematically illustrates an example circuit for a high voltage module.

FIG. 12 illustrates an example circuit for the trigger pulse module of FIGS. 1 and 11. FIG. 13 illustrates an example circuit for the high voltage module of FIGS. 1 and 11. Example components for these circuits are set out in table 1 below:

TABLE 1

| REFERENCE | ELEMENT |
|---|---|
| 320 | 115 VAC source |
| 321 | ¼ AMP fuse |
| 322 | filter |
| 323 | Transf. - 115 VAC/16 VAC |
| 324 | TL 317C |
| 325 | 500 Ω |
| 326 | IN4948 |
| 327 | .5 μf |
| 328 | 0–20 VDC meter |
| 329 | 100 μf |
| 330 | 470 Ω |
| 331 | 5 KΩ |
| 332 | 100 μf |
| 333 | line to Gate signal pulse generator |
| 334 | IGBT HARRIS # HGTG24N60DID |
| 335 | Transf. - TR149 1:42 |
| 336 | 3 Meg Ω |
| 337 | 470 K Ω |
| 338 | 30 nf |
| 339 | 2 KΩ |
| 340 | 2.7 KΩ |
| 341 | 0.5 nf |
| 342 | 2 KΩ |
| 343 | Universal Voltronics - 16 KV 5.5 mA |
| 345 | H.V. P/S 20 KV 5.5 mA |
| 346 | 500 nf |
| 348 | dump switch |
| 349 | 3900 Ω |
| 350 | outlet to radiation head |

Figure 14:
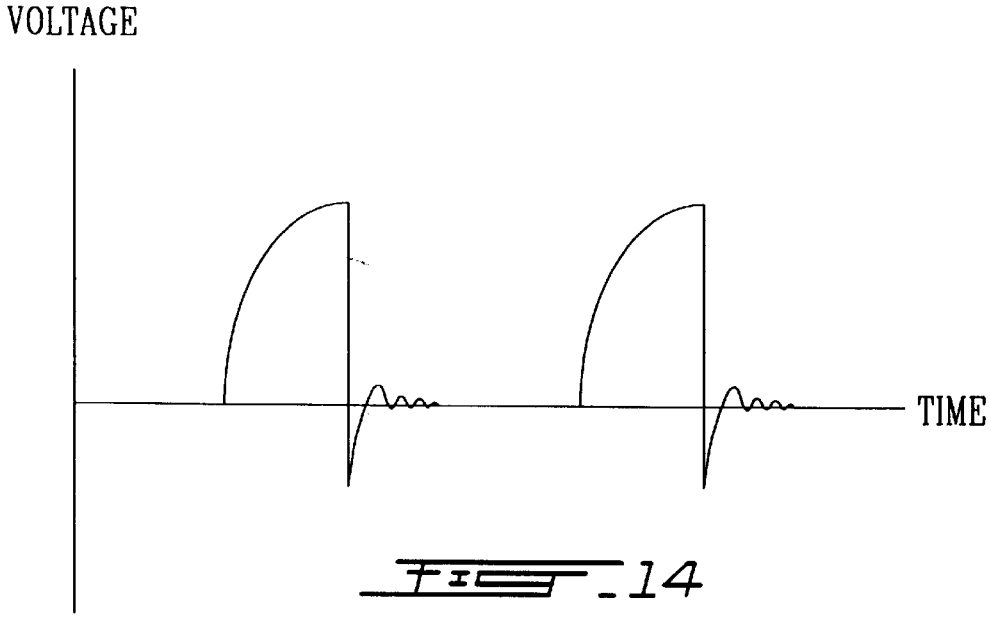
FIG. 14 is a graph of voltage versus time for the charge/recharge of a capacitor and the trigger pulse voltage
Figure 15:
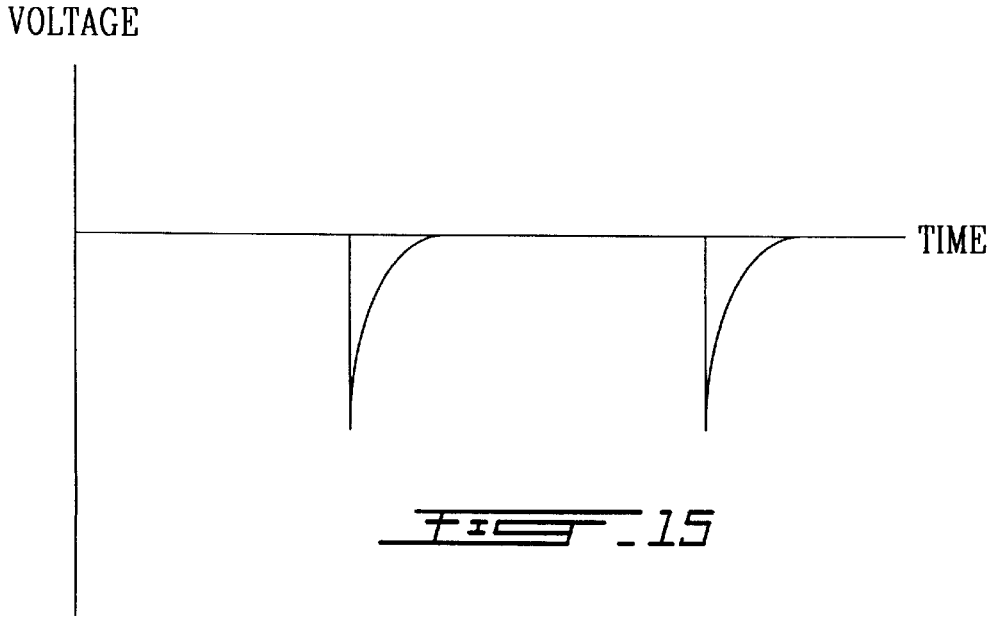
FIG. 15 is a graph of voltage versus time for the trigger pulse voltage.

FIG. 14 is a graph of voltage versus time for the relative charge and discharge of the storage capacitor, between anode and cathode; FIG. 15 is a graph of voltage versus time for the trigger voltage pulse between the trigger electrode and cathode. These figures also illustrates the relationship of the trigger pulse and the discharge of the storage capacitor.

It may be advantageous to have means for cooling the anode tip end component. FIGS. 16 to 19 illustrate in schematic fashion an example mechanism for cooling the anode tip end component. As may be seen the anode tip end component 360 comprises an outer capillary tube 362 and an inner capillary tube 363. The walls of the capillary tubes 362 and 363 define an inlet passageway 370 and an outlet passageway 372. The working end of the anode tip end component is capped by a capping member which comprises a channel flange plate 365, a covering plate 366 and a tungsten face plate 368; the plates may be attached to each other in any suitable (known) manner keeping in mind the purpose thereof, i.e. to provide cooling to the tungsten face plate during use.

Figure 17:
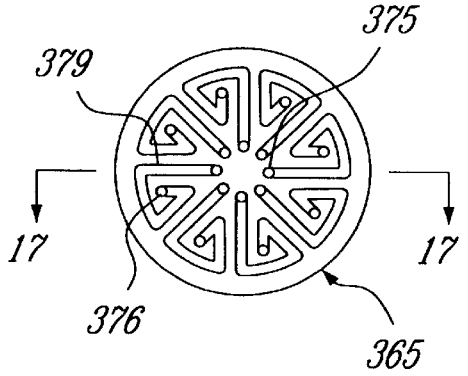
FIG. 17 is schematic illustration of a channel flange plate for the anode tip end component shown in FIG. 16.
Figure 18:
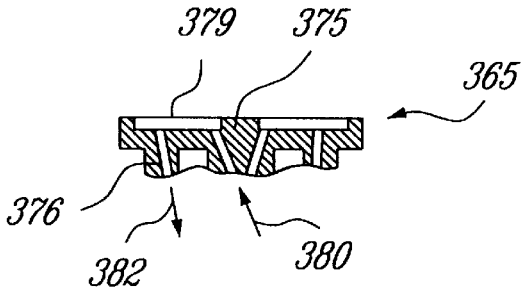
FIG. 18 is schematic illustration of a cross section along 17—17 of the channel flange plate shown in FIG. 17.

The channel flange plate 365 as may be seen from FIGS. 17 and 18 is provided with a series of channels which allow for liquid communication between the inlet and outlet sides of capillary tubes 362 and 363. Referring to FIG. 17 which is a top view of the channel flange plate 365 as well as FIG. 18, the channel flange plate 365 has liquid inlets and outlets one of each of which is respectively designated with the numeral 375 and 376; the inlets and outlets are interconnected by intermediate channel members, one of which is designated with the reference numeral 379. Referring to FIG. 18, as may be understood liquid coolant such as water for example, may pass from the inlet passageway 370 in the direction of the arrow 380 to the intermediate channel member 379 on to the outlet 376 for access to the outlet passageway 382.

Figure 16:
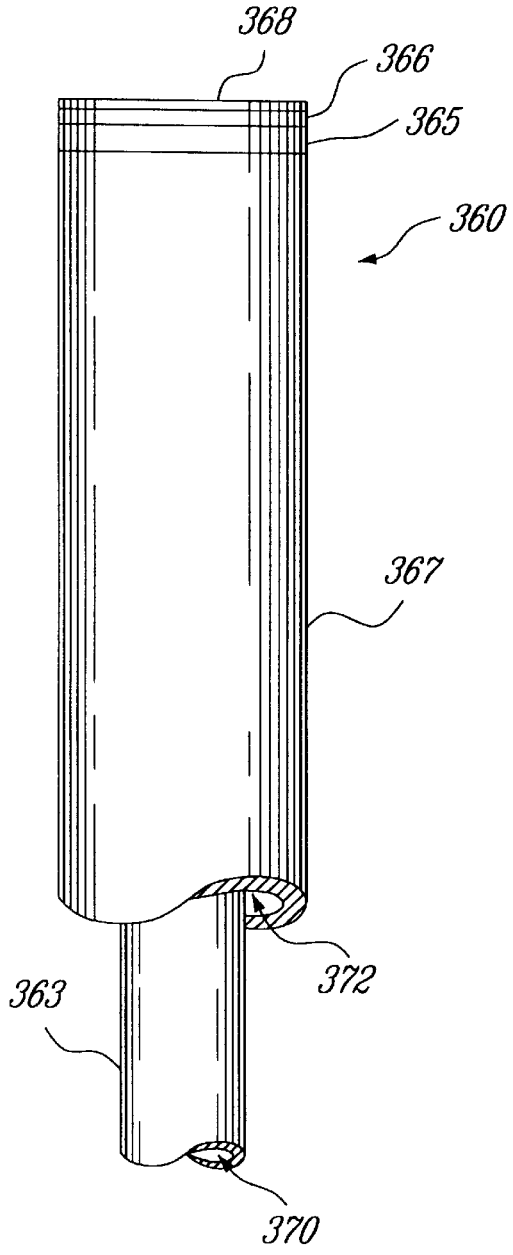
FIG. 16 is schematic illustration of a liquid coolable anode tip end component.
Figure 19:
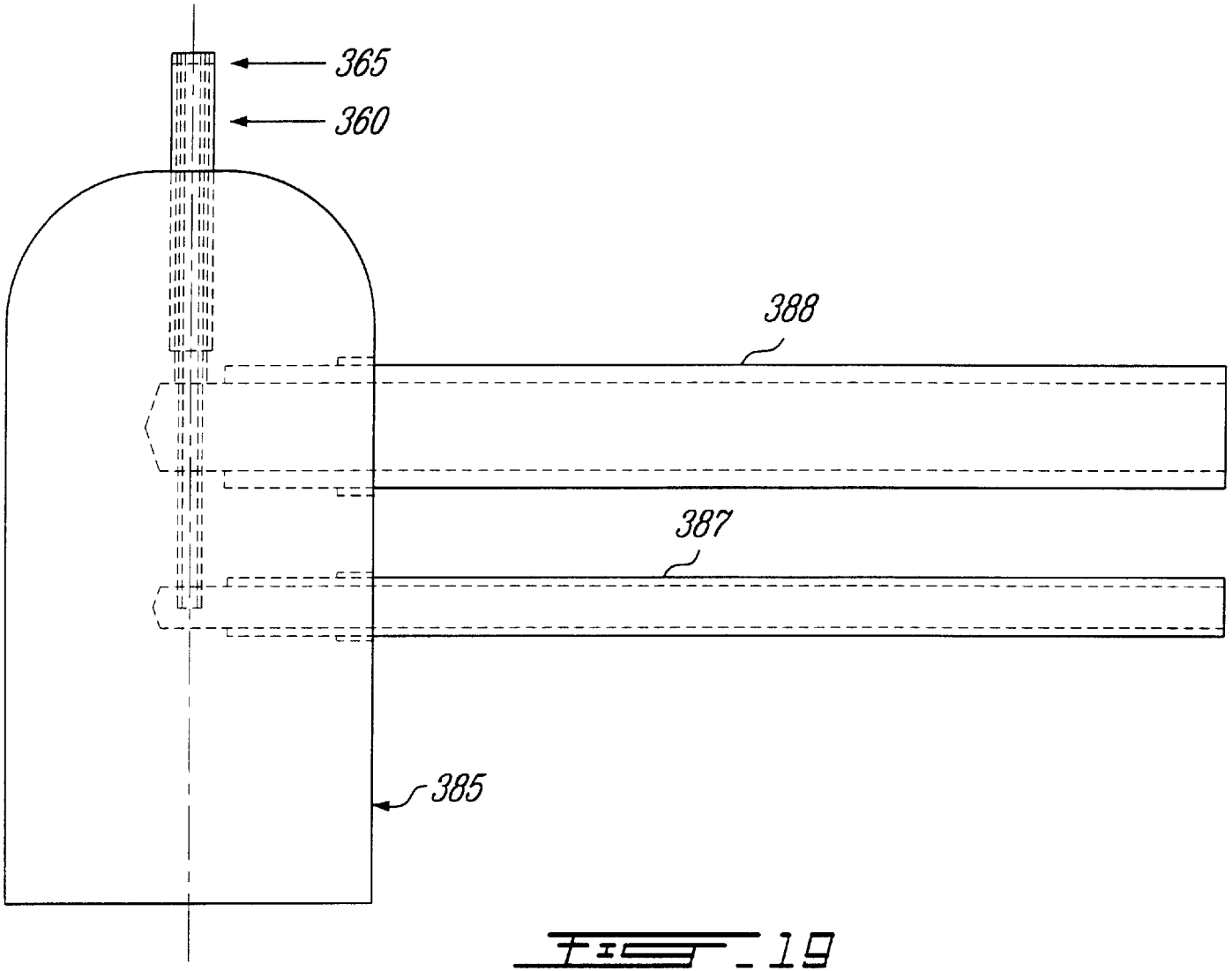
FIG. 19 is schematic illustration of the coolable anode tip end component of FIG. 16 attached to an anode nut member.

FIG. 19 illustrates in schematic fashion coolable anode tip end component 360 as shown in FIGS. 16 to 18 attached to an anode nut 385. The anode nut 385 is provided with a channel member 387 for feeding liquid coolant to the inlet passageway 372 of the anode tip end component 360 and a channel member 388 for removing or exhausting spent cooling liquid away from the outlet passageway of the anode tip end component 360.

We claim:

1. A radiation head for the generation of predetermined electromagnetic radiation comprising a radiation generation chamber, an anode means having a tip end component, a cathode means, and a trigger electrode said chamber having a radiation transmitting window of a material preferentially transparent to a predetermined radiation generated in said chamber and through which the predetermined radiation may be emitted from said radiation head, said anode means and cathode means being disposed in said chamber, said tip end component comprising a material able to facilitate, in response to a pulse voltage applied between said anode and cathode, the generation of electromagnetic radiation, said tip end component, said cathode means and said trigger electrode being space apart from each other by a respective predetermined distance, characterised in that said radiation head comprises capacitor means for storing electric energy supplied by a high voltage source, said capacitor means comprising a terminal electrode for connection to said anode means, and said anode means being directly electrically connected to said terminal electrode of said capacitor means so as to be integral with the capacitor means.

2. A radiation head as defined in claim 1 wherein said terminal electrode is disposed in said radiation generation chamber.

3. A radiation head as defined in claim 2 for the generation of X-rays wherein said chamber has an X-ray transmitting window of a material preferentially transparent to X-rays generated in said chamber and through which X-rays may be emitted from said radiation head.

4. A radiation head as defined in claim 3 wherein said trigger electrode is disposed between the anode means and the cathode means.

5. A radiation head as defined in claim 3 wherein said trigger electrode comprises a peripheral element defining a trigger passageway.

6. A radiation head as defined in claim 3 wherein said cathode means comprises a hollow cathode component having a cathode passageway extending there through.

7. A radiation head as defined in claim 6 wherein said cathode passageway has a longitudinal axis and wherein said trigger electrode comprises a peripheral component defining a trigger passageway, said trigger passageway having an axis coincident with the longitudinal axis of said cathode passageway.

8. A radiation head as defined in claim 7 wherein the tip end component comprises at least one tip end element aligned with the cathode passageway.

9. A radiation head as defined in claim 7 wherein said cathode has a frustoconical shaped passageway having a small opening end and a large opening end, said frustoconical shaped passageway having a central longitudinal axis passing through said small and large openings, said tip end component comprising at least one tip end element facing said small opening end and having an axis aligned with said central axis.

10. A radiation head as defined in claim 7 wherein said cathode has a frustoconical shaped passageway having a small opening end and a large opening end, said frustoconical shaped passageway having a central longitudinal axis passing through said small and large openings, said tip end component comprising at least one tip end element facing said small opening end and having an axis aligned with said central axis.

11. A radiation head as defined in claim 6 wherein the tip end component comprises at least one tip end element aligned with the cathode passageway.

12. A radiation head as defined in claim 3 wherein said trigger electrode comprises an outer annular component, wherein said cathode means comprises a hollow cathode component having a cathode passageway extending there through, said hollow cathode component comprising an inner annular element defining at least a portion of said cathode passageway and wherein said outer annular component is disposed coaxially with said inner annular element.

13. A radiation head as defined in claim 12 wherein the tip end component comprises at least one tip end element aligned with the cathode passageway.

14. An X-ray pulse generator system comprising:

an X-ray emitting head as defined in claim 3 and trigger voltage pulse means for applying a voltage pulse to said trigger electrode whereby electric energy stored in the capacitor means is released between said anode and said cathode.

15. An X-ray pulse generator system as defined in claim 14 comprising a high voltage source for supplying high voltage to said capacitor means.

16. A radiation head as defined in claim 1 wherein said capacitor means is disposed within said radiation generation chamber.

17. A radiation head as defined in claim 16 for the generation of X-rays wherein said chamber has an X-ray transmitting window of a material preferentially transparent to X-rays generated in said chamber and through which X-rays may be emitted from said radiation head.

18. A radiation head as defined in claim 17 wherein said trigger electrode is disposed between the anode means and the cathode means.

19. A radiation head as defined in claim 17 wherein said trigger electrode comprises a peripheral element defining a trigger passageway.

20. A radiation head as defined in claim 17 wherein said cathode means comprises a hollow cathode component having a cathode passageway extending there through.

21. A radiation head as defined in claim 20 wherein said cathode passageway has a longitudinal axis and wherein said trigger electrode comprises a peripheral component defining a trigger passageway, said trigger passageway having an axis coincident with the longitudinal axis of said cathode passageway.

22. A radiation head as defined in claim 21 wherein the tip end component comprises at least one tip end element aligned with the cathode passageway.

23. A radiation head as defined in claim 20 wherein the tip end component comprises at least one tip end element aligned with the cathode passageway.

24. A radiation head as defined in claim 17 wherein said trigger electrode comprises an outer annular component, wherein said cathode means comprises a hollow cathode component having a cathode passageway extending there through, said hollow cathode component comprising an inner annular element defining at least a portion of said cathode passageway and wherein said outer annular component is disposed coaxially with said inner annular element.

25. A radiation head as defined in claim 24 wherein the tip end component comprises at least one tip end element aligned with the cathode passageway.

26. An X-ray pulse generator system comprising:

an X-ray emitting head as defined in claim 17 and trigger voltage pulse means for applying a voltage pulse to said trigger electrode whereby electric energy stored in the capacitor means is released between said anode and said cathode.

27. An X-ray pulse generator system as defined in claim 26 comprising a high voltage source for supplying high voltage to said capacitor means.

28. A radiation head as defined in claim 1 for the generation of X-rays wherein said chamber has an X-ray transmitting window of a material preferentially transparent to X-rays generated in said chamber and through which X-rays may be emitted from said radiation head.

29. A radiation head as defined in claim 28 wherein said trigger electrode is disposed between the anode means and the cathode means.

30. A radiation head as defined in claim 28 wherein said trigger electrode comprises a peripheral element defining a trigger passageway.

31. A radiation head as defined in claim 28 wherein said cathode means comprises a hollow cathode component having a cathode passageway extending there through.

32. A radiation head as defined in claim 31 wherein said cathode passageway has a longitudinal axis and wherein said trigger electrode comprises a peripheral component defining a trigger passageway, said trigger passageway having an axis coincident with the longitudinal axis of said cathode passageway.

33. A radiation head as defined in claim 32 wherein the tip end component comprises at least one tip end element aligned with the cathode passageway.

34. A radiation head as defined in claim 32 wherein said cathode has a frustoconical shaped passageway having a small opening end and a large opening end, said frustoconical shaped passageway having a central longitudinal axis passing through said small and large openings, said tip end component comprising at least one tip end element facing said small opening end and having an axis aligned with said central axis.

35. A radiation head as defined in claim 31 wherein the tip end component comprises at least one tip end element aligned with the cathode passageway.

36. A radiation head as defined in claim 28 wherein said trigger electrode comprises an outer annular component, wherein said cathode means comprises a hollow cathode component having a cathode passageway extending there through, said hollow cathode component comprising an inner annular element defining at least a portion of said cathode passageway and wherein said outer annular component is disposed coaxially with said inner annular element.

37. A radiation head as defined in claim 36 wherein the tip end component comprises at least one tip end element aligned with the cathode passageway.

38. An X-ray pulse generator system comprising:

an X-ray emitting head as defined in claim 28 and trigger voltage pulse means for applying a voltage pulse to said trigger electrode whereby electric energy stored in the capacitor means is released between said anode and said cathode.

39. An X-ray pulse generator system as defined in claim 38 comprising a high voltage source for supplying high voltage to said capacitor means.

* * * * *